US008264912B2

(12) United States Patent
Watanabe

(10) Patent No.: US 8,264,912 B2
(45) Date of Patent: Sep. 11, 2012

(54) WATCH WITH CALENDAR MECHANISM HAVING TWO DATE INDICATORS

(75) Inventor: Mamoru Watanabe, Chiba (JP)

(73) Assignee: Seiko Instruments Inc. (JP)

( * ) Notice: Subject to any disclaimer, the term of this patent is extended or adjusted under 35 U.S.C. 154(b) by 317 days.

(21) Appl. No.: 12/657,600

(22) Filed: Jan. 22, 2010

(65) Prior Publication Data

US 2010/0188937 A1 Jul. 29, 2010

(30) Foreign Application Priority Data

Jan. 23, 2009 (JP) ..... 2009-013338

(51) Int. Cl.
*G04B 19/20* (2006.01)

(52) U.S. Cl. ..... 368/38; 368/37

(58) Field of Classification Search ..... 368/35, 368/36, 37, 38, 39
See application file for complete search history.

(56) References Cited

U.S. PATENT DOCUMENTS 6,108,278 A * 8/2000 Rochat ..... 368/28
7,023,762 B1 * 4/2006 Burkhardt et al. ..... 368/35
7,102,962 B2 * 9/2006 Suzuki ..... 368/37
7,254,094 B2 * 8/2007 Watanabe ..... 368/37
2005/0169108 A1 8/2005 Watanabe ..... 368/37
2006/0028918 A1 2/2006 Groothuis et al. ..... 368/37

OTHER PUBLICATIONS

Abstract, Publication No. WO9913383, Publication Date Mar. 18, 1999.
Abstract, Publication No. JP2000314779, Publication Date Nov. 14, 2000.

* cited by examiner

*Primary Examiner* — Renee S Luebke
*Assistant Examiner* — Jason Collins
(74) *Attorney, Agent, or Firm* — Adams & Wilks

(57) ABSTRACT

A watch with a calendar mechanism has a rotatable first date indicator for displaying a ones place of a date, a rotatable second date indicator for displaying a tens place of the date, and a second date indicator feeding lever for rotating the second date indicator. The first date indicator has calendar shift teeth and first date indicator tooth portions. The calendar shift teeth include a first calendar shift tooth, a second calendar shift tooth arranged relative to the first calendar shift tooth at a first interval, a third calendar shift tooth arranged relative to the second calendar shift tooth at a second interval greater than the first interval, and a fourth calendar shift tooth arranged relative to the first calendar shift tooth at a third interval greater than each of the first and second intervals. The second date indicator feeding lever has a spring portion and is mounted to undergo movement from a first position toward the second date indicator in accordance with rotation of the first date indicator and is restored to the first position by a spring force of the spring portion.

10 Claims, 25 Drawing Sheets

WATCH WITH CALENDAR MECHANISM HAVING TWO DATE INDICATORS

BACKGROUND OF THE INVENTION

1. Field of the Invention

The present invention relates to a watch with a calendar mechanism including a first date indicator indicating the one place of a date and a second date indicator indicating the ten place of a date.

2. Description of the Related Art

The mechanical structure including the driving portion of a watch is generally referred to as the "movement." What is obtained by mounting a dial and hands to the movement and putting it into a watch case to attain a complete whole is referred to as the "complete" of a watch. Of the two sides of a main plate constituting the base plate of a watch, the side where the glass of the watch case is provided, that is, the side where the dial exists, is referred to as the "back, side" or the "glass side" or the "dial side" of the movement. Of the two sides of the main plate, the side where the case back of the watch case exists, that is, the side opposite to the dial, is referred to as the "front side" or the "case back side" of the movement. A train wheel attached to the "front side" of the movement is referred to as the "front train wheel." A train wheel attached to the "back side" of the movement is referred to as the "back train wheel."

Generally speaking, in an analog watch, the "12 o'clock side" refers to the side where a scale corresponding to 12 o'clock of a dial is arranged. In an analog watch, the "12 o'clock direction" means a direction from the rotation center of an indicator hand toward the "12 o'clock side." In an analog watch, the "3 o'clock side" refers to the side where a scale corresponding to 3 o'clock of the dial is arranged. In an analog watch, the "3 o'clock direction" means a direction from the rotation center of an indicator hand toward the "3 o'clock side." In an analog watch, the "6 o'clock side" refers to the side where a scale corresponding to 6 o'clock of the dial is arranged. In an analog watch, the "6 o'clock direction" means a direction from the rotation center of an indicator hand toward "6 o'clock side". In an analog watch, the "9 o'clock side" refers to the side where a scale corresponding to 9 o'clock of the dial is arranged. In an analog watch, the "9 o'clock direction" means a direction from the rotation center of the indicator hand toward the "9 o'clock side." Further, in some cases, there are used terms implying sides where other scales of the dial are arranged as in the case of the "2 o'clock direction" and "2 o'clock side."

In a first type of conventional watch with a calendar mechanism, there are provided a one-place rotary body (i.e., a first date indicator) on which there are arranged a dial having a large window and one number "1" and 31 numbers including 3 sets of numbers "1" through "9" and "0" and which is provided with four teeth, and a 10-place star plate (i.e., a second date indicator) which has four teeth and on which there are arranged the numbers "0," "1," "2," and "3." The 1-place rotary body (i.e., the first date indicator) directly rotates the 10-place rotary body (i.e., the second date indicator) (See, for example, Japanese Patent No. 3390021).

A second type of conventional watch with a calendar mechanism includes a first date plate indicating the 1 place of a date (i.e., a first date indicator), a second date plate indicating the 10 place of a date (i.e., a second date indicator), a date feeding wheel driving the first date plate, a feeding finger provided on the first date plate, an intermediate wheel driven by the feeding finger, a first jump control lever rotating the first date plate halfway through feeding to stop it at a stable position, and a second jump control lever rotating the second date plate halfway through feeding to stop it at a stable position. Arranged on the first date plate (i.e., the first date indicator) are 20 numbers including two sets of 20 numbers including the numbers "1" through "9" and "0" (See, for example, Patent Document JP-A-2000-314779).

A third type of conventional watch with a calendar mechanism comprises a first date indicator indicating the 1 place of a date, a first date jumper for setting the position in the rotating direction of the first date indicator, a second date indicator indicating the 10 place of a date, a second date jumper for setting the position in the rotating direction of the second date indicator, and a date intermediate wheel adapted to rotate based on the rotation of the first date indicator and capable of rotating the second date indicator. An indicator for displaying time information is operated by a step motor, and the first date indicator is operated by an ultrasonic motor (See, for example, Patent Document JP-A-2005-214836).

In a fourth type of conventional watch with a calendar mechanism, a figure-place-take-up tooth provided on a first date plate is connected to a second date plate via two date intermediate cogwheels. Date switching is effected by feeding the first date plate with 40 teeth by 2 teeth (See, for example, Patent Document JP-A-2000-292557).

A fifth type of conventional watch with a calendar mechanism is equipped with two moving bodies each carrying a number group arrangement. A second moving body is driven by a first moving body via a star retained by a jumper. A protruding element is arranged so as to prevent jumping from one tooth to a non-adjacent tooth of the star at the time of date change. The protruding element is displaced within a slider (See, for example, Patent Document JP-T-2006-522323).

The first type of conventional watch equipped with a calendar mechanism is equipped with a 1-place rotary member on which there are arranged the number "1" and 31 numbers including 3 sets of numbers of "1" through "9" and "0," so that it is at the end of February, April, June, September, and November that the calendar mechanism needs correction at the end of a month. That is the calendar mechanism has to be corrected five times a year. However, in the first type of conventional watch with a calendar mechanism, the 1-place rotary member directly rotates the 10-place rotary member, so that it is impossible to arrange the 1-place rotary member and the 10-place rotary member such that they share the same rotation center. Thus, in designing the two rotary members, there are limitations regarding the position at which display of date is possible by the two rotary members.

In the second type of conventional watch with a calendar mechanism, there is a fear of the first date indicator being excessively rotated when correcting the date such that the first date indicator and the second date indicator become out of phase with each other. In this construction, there is a fear of a correct date display being impossible to achieve. To prevent this problem, it is necessary for the restraining force of the date jumper (i.e., the force of the second date jumper) to be large enough so as to be superior to the inertial force the first date indicator. Thus, in the third type of conventional watch with a calendar mechanism, it is necessary to increase the operational force applied to the train wheel for feeding the date indicators, resulting in an increase in the size and thickness of the watch.

The third type of conventional watch with a calendar mechanism includes a step motor and an ultrasonic motor, so that the date feeding mechanism is rather thick, and the motor driving circuit is complicated, with the IC size being rather large, which makes it necessary to provide a large number of electronic components.

In the fourth type of conventional watch with a calendar mechanism, there are arranged on the first date plate two sets of numbers of "0" and "1" through "9," that is, 20 numbers. Thus, it is at the end of each month that the calendar mechanism requires correction. That is, the calendar mechanism has to be corrected twelve times a year.

In the fifth type of conventional watch with a calendar mechanism, the protruding element is formed integrally with the jumper. When the jumper follows the tooth portion when the user rotates the crown to correct the date display, the protruding element does not come into contact with the slider outer wall, and there is a fear of occurrence of excessive rotation (that is, the date display moving body carrying the number group arrangement is allowed to make excessive rotation due to the inertia during rotation, i.e., so-called "over-rotation").

SUMMARY OF THE INVENTION

It is an aspect of the present invention to provide a watch with a calendar mechanism which includes a first date indicator displaying the 1 place of a date and a second date indicator displaying the 10 place of a date, wherein there is involved no increase in the number of times that the calendar mechanism has to be corrected at the ends of months, thus providing a watch with a calendar mechanism of a satisfactory operability.

It is another aspect of the present invention to provide a watch with a calendar mechanism which includes a first date indicator displaying the 1 place of a date and a second date indicator displaying the 10 place of a date, wherein the rotation center of the first date indicator and the rotation center of the second date indicator are arranged at the same position, thereby providing a watch with a calendar mechanism capable of reliably displaying dates in large letters, small in thickness, and little restricted in terms of design.

It is still another aspect of the present invention to provide a watch with a calendar mechanism including a first date indicator and a second date indicator, wherein it is possible to prevent occurrence of excessive rotation of the second date indicator when performing date correction.

According to the present invention, there is provided a watch with a calendar mechanism having two date indicators comprising a first date indicator displaying the 1 place of a date, a first date jumper for setting the position in the rotating direction of the first date indicator, a second date indicator displaying the 10 place of a date, a second date jumper for setting the position in the rotating direction of the second date indicator, and a second date indicator feeding lever capable of moving based on the rotation of the first date indicator and rotating the second date indicator. The rotation center of the first date indicator and the rotation center of the second date indicator are arranged so as to be at the same position.

In the watch with a calendar mechanism of the present invention, the first date indicator includes 31 first date indicator tooth portions formed as inner teeth, and four calendar shift teeth formed as inner teeth; the first date indicator tooth portions are formed at equal angular intervals; and the calendar shift teeth consist of a first calendar shift tooth serving as a reference, a second calendar shift tooth formed at an interval of (360*2/31) degrees in a first direction (e.g., clockwise) using the first calendar shift tooth as a reference, a third calendar shift tooth formed at an interval of (360*9/31) degrees in the first direction (e.g., clockwise) using the second calendar shift tooth as a reference, and a fourth calendar shift tooth formed at an interval of (360*10/31) degrees in a direction opposite to the first direction (e.g., counterclockwise) using the first calendar shift tooth as a reference. Due to this construction, there is involved no increase in the number of times that the calendar mechanism has to be corrected at month ends, resulting in a satisfactory operability. Further, the watch with a calendar mechanism of the present invention can reliably display dates in large letters, is small in thickness, and little restricted in terms of design.

In the watch with a calendar mechanism of the present invention, it is desirable for the second date indicator feeding lever to move toward the second date indicator based on the rotation of the first date indicator and to be restored to the former position by a spring force. Due to this construction, it is possible to realize a thin watch with a calendar mechanism.

In the watch with a calendar mechanism of the present invention, it is desirable for the second date indicator feeding lever to move while guided by a second date indicator feeding lever guide pin. Due to this construction, it is possible to realize a thin watch with a calendar mechanism in which the operation of the calendar mechanism is reliable.

In the watch with a calendar mechanism of the present invention, it is desirable to provide a baffle pin for preventing excessive rotation of the second date indicator; when the second date indicator makes an excessive rotation, the second date indicator feeding lever is capable of coming into contact with the baffle pin. Due to this construction, when the user rotates the crown to perform date display correction, it is possible to prevent occurrence of excessive rotation of the second date indicator, so that there is no fear of the first date indicator and the second date indicator becoming out of phase with each other.

Next, the operation of changing the date display of "31" to "01" will be described. The first date indicator is rotated through rotation of the date feeding finger that is rotated by rotation of a date indicator driving wheel. The second calendar shift tooth of the first date indicator comes into contact with a lever feeding operation portion of a second date indicator feeding lever. When the second date indicator feeding portion comes into contact with a positioning tooth portion of a second date star, the second date indicator rotates. The second date indicator feeding lever rotates the positioning tooth portion of the second date star, and the second date indicator rotates by one pitch by the force of the second date jumper; and "0" of the second date letters is arranged in the left-hand side portion of a date window provided in the dial. The first date indicator is rotated by one pitch by the force of the first date jumper, and "1" of the first date letters is arranged in the right-hand side portion of the date window provided in the dial.

Next, the operation of changing the date display from "01" to "02" will be described. The first date indicator is rotated by one pitch by the force of the first date jumper, and, of the first date letters, the letter "2" adjacent to "1" is arranged in the right-hand side portion of the date window provided in the dial. At the time of this operation, the second date indicator does not rotate. That is, "0" of the second date letters remains arranged in the left-hand side portion of the date window provided in the dial.

Next, the operation of changing the date display from "09" to "10" will be described. Through rotation of the date indicator driving wheel, the date feeding finger also rotates. When the first date indicator rotates through the rotation of the date feeding finger, the second calendar shift tooth of the first date indicator comes into contact with the lever feeding operation portion of the second date indicator feeding lever. When the second date indicator feeding portion of the second date indicator feeding lever comes into contact with the positioning tooth portion of the second date star, the second date indicator rotates. The second date indictor feeding lever rotates the positioning tooth portion of the second date star, and, the second date indicator is rotated by one pitch by the force of the second date jumper, with "1" of the second date letters being arranged in the left-hand side portion of the date window provided in the dial. Through further rotation of the date feeding finger, the first date indicator is rotated by one pitch by the force of the first date jumper, with "0" of the first date letters being arranged in the right-hand side portion of the date window provided in the dial.

According to the present invention, there is provided a watch with a calendar mechanism including a first date indicator displaying the 1 place of a date and a second date indicator displaying the 10 place of a date, wherein there is involved no increase in the number of times that the calendar mechanism has to be corrected at month ends, thus providing a satisfactory operability. Further, the watch with a calendar mechanism of the present invention is capable of reliably displaying dates in large letters, small in thickness, and little restricted in terms of design. Further, in the watch with a calendar mechanism of the present invention, when the user rotates the crown to perform date display correction, it is possible to prevent occurrence of excessive rotation of the second date indicator, and there is no fear of the first date indicator and the second date indicator becoming out of phase with each other.

Figure 1:
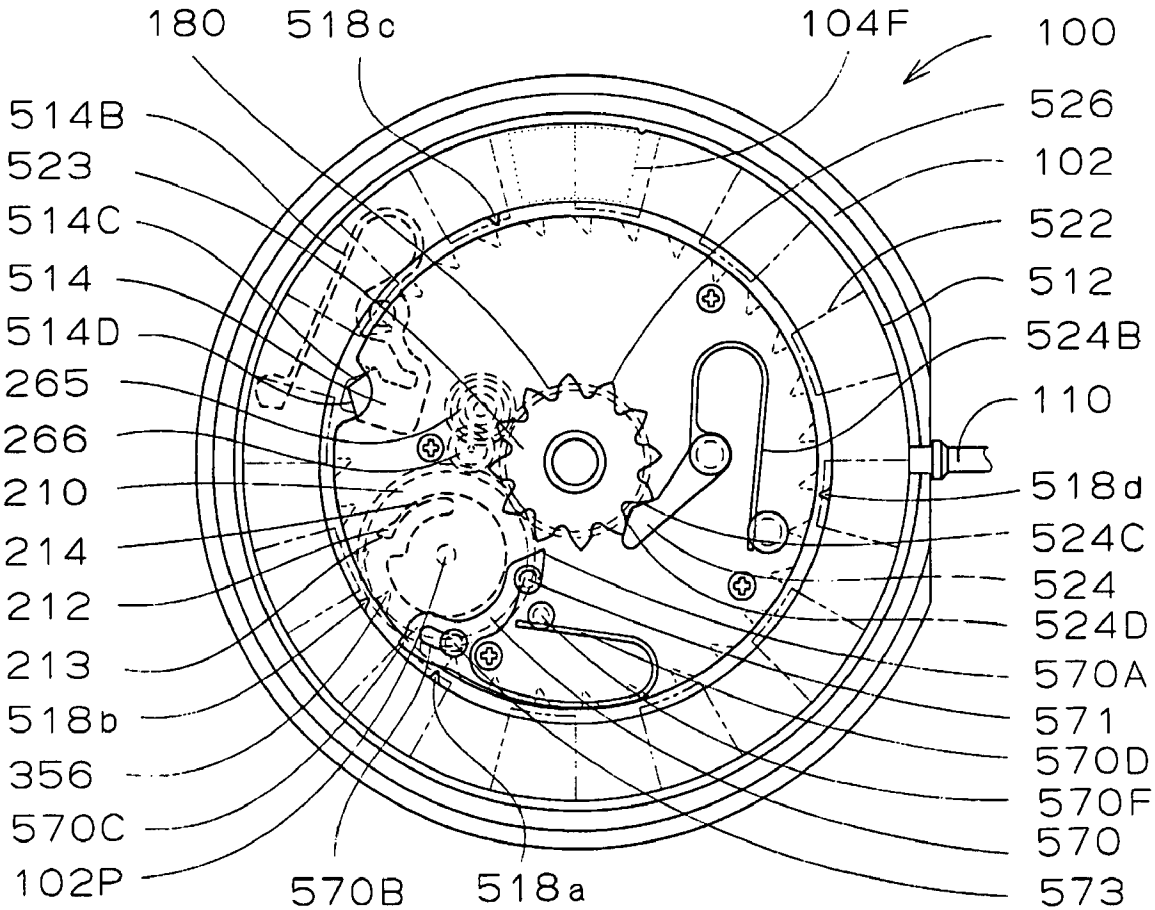
FIG. 1 is a schematic plan view of the structure of a movement as seen from the dial side of a watch with a calendar mechanism according to a first embodiment of the present invention.

DETAILED DESCRIPTION OF THE PREFERRED EMBODIMENTS (1) First Embodiment:

In the following description, a watch with a calendar mechanism according to the first embodiment of the present invention will be described with reference to the drawings. In the embodiment described below, the watch with a calendar mechanism is formed as a mechanical watch. While in the following the watch with a calendar mechanism of the present description is described as applied to a mechanical watch, the present invention is applicable not only to a mechanical watch but also to an analog electronic watch. That is, in this specification, the concept of "watch with a calendar mechanism" is a concept that also includes an "analog electronic watch" and analog watches of all the other operating principles.

(1.1) General Construction of the Movement:

Referring to FIGS. 1 through 3 and 22, a movement 100 is formed by a mechanical watch. The movement 100 includes a main plate 102 constituting the base plate of the movement 100. A dial 104 is mounted to the glass side of the movement 100. A winding stem 110 is rotatably incorporated into the main plate 102. A switching device includes the winding stem 110, a setting lever 120, a yoke 122, and a yoke holder 124. A setting device includes a balance setting lever 170 and a balance setting pin 170A. The balance setting pin 170A is preferably fixed to the balance setting lever 170.

(1.2) Construction of the Front Side of the Movement

Next, the construction of the front side of the movement will be described. Referring to FIGS. 2, 3, 21, and 22, the movement (mechanical structure) 100 has the main plate 102 constituting the base plate of the movement. The winding stem 110 is arranged in the "3 o'clock direction" of the movement. The winding stem 110 is rotatably incorporated into a winding stem guide hole of the main plate 102. A dial 104 is mounted to the movement 100. A dial support 105 is arranged between the dial 104 and the main plate 102. An escapement/governing device including a balance with hairspring 340, an escape wheel & pinion 330, and a pallet fork 342, and a front train wheel including a second wheel & pinion 327, a third wheel & pinion 326, a center wheel & pinion 325, and a movement barrel 320, are arranged on the "front side" of the movement 100. The switching device including the setting lever 120, the yoke 122, and the yoke holder 124 is arranged on the "back side" of the movement 100. Further, there are arranged on the "front side" of the movement 100 a barrel bridge (not shown) rotatably supporting an upper shaft portion of the movement barrel 320, a train wheel bridge (not shown) rotatably supporting an upper shaft portion of the third wheel & pinion 326, an upper shaft portion of the second wheel & pinion 327, and an upper shaft portion of an escape wheel & pinion 330, a pallet bridge (not shown) rotatably supporting an upper shaft portion of the pallet fork 342, and a pallet bridge (not shown) rotatably supporting an upper shaft portion of the balance with hairspring 340.

A crown wheel (not shown) is constructed so as to rotate through rotation of a winding pinion 116. A crown transmission wheel (not shown) is constructed so as to rotate through rotation of the crown wheel. A ratchet sliding wheel (not shown) is constructed so as to rotate through rotation of the crown transmission wheel. A ratchet wheel (not shown) rotates through rotation of the ratchet sliding wheel. The movement barrel 320 is equipped with a barrel wheel, a barrel arbor, and a mainspring. Through rotation of the ratchet wheel, the mainspring accommodated in the movement barrel 320 is wound up.

The center wheel & pinion 325 is constructed so as to rotate through rotation of the movement barrel 320. The center wheel & pinion 325 includes a center wheel and a center pinion. The barrel wheel is constructed so as to be in mesh with the center pinion. The third wheel & pinion 326 is constructed so as to rotate through rotation of the center wheel & pinion 325. The third wheel & pinion 326 includes a third wheel and a third pinion. The second wheel & pinion 327 is constructed so as to make one rotation per minute through rotation of the third wheel & pinion 326. The third wheel is constructed so as to be in mesh with the second pinion. The escape wheel & pinion 330 is constructed so as to rotate through rotation of the second wheel & pinion 327 while controlled by the pallet fork 342. The escape wheel & pinion 330 includes an escape wheel and an escape pinion. The second wheel & pinion is constructed so as to be in mesh with the escape pinion. A minute indicator 329 is constructed so as to rotate through rotation of the movement barrel 320. The movement barrel 320, the center wheel & pinion 325, the third wheel & pinion 326, the second wheel & pinion 327, and the minute indicator 329 constitute the front train wheel. The escapement/governing device for controlling the rotation of the front train wheel includes the balance with hairspring 340, the escape wheel & pinion 330, and the pallet fork 342. The escape wheel & pinion 330, the pallet fork 342, and the balance with hairspring 340 constitute the escapement/governing device. The balance with hairspring 340 includes a balance staff, a balance wheel, and a hairspring. The hairspring is a thin plate spring of a spiral configuration having a plurality of turns. The balance with hairspring 340 is supported so as to be rotatable with respect to the main plate 102 and a balance bridge.

The movement barrel 320 is supported so as to be rotatable with respect to the main spring 102 and the barrel bridge. The center wheel & pinion 325 is supported so as to be rotatable with respect to the main plate 102 and a center wheel bridge (not shown). A lower shaft portion of the third wheel & pinion 326 and a lower shaft portion of the escape wheel & pinion 330 are supported so as to be rotatable with respect to the main plate 102. An upper shaft portion of the third wheel & pinion 326, an upper shaft portion of the second wheel & pinion 327, and an upper shaft portion of the escape wheel & pinion 330 are rotatably supported with respect to a train wheel bridge (not shown). The minute indicator 329 is rotatably supported by the outer portion of a central pipe 103 fixed to the center wheel bridge (not shown). A lower shaft portion of the second wheel & pinion 327 is rotatably supported in a central hole of the central pipe 103 fixed to the center wheel bridge (not shown). The pallet fork 342 and the main plate 102 are supported so as to be rotatable with respect to the main plate 102 and the pallet bridge 364. An upper shaft portion of the pallet fork 342 is supported so as to be rotatable with respect to the pallet bridge 364. A lower shaft portion of the pallet fork 342 is supported so as to be rotatable with respect to the main plate 102.

A minute wheel 166 is constructed so as to rotate based on the rotation of the minute indicator 329. An hour wheel 180 is constructed so as to rotate based on the rotation of the minute wheel 166. Through the rotation of the center wheel & pinion 325, the second wheel & pinion 327 makes one rotation per minute via the rotation of the third wheel & pinion 326. The hour wheel 180 is constructed so as to make one rotation every 12 hours. Through the rotation of the third wheel & pinion 326, the minute indicator 329 rotates. A slip mechanism is provided on the minute indicator 329. The minute indicator 329 is constructed so as to make one rotation per hour.

(1.3) Construction of the Switching Device

Next, the construction of the switching device will be described. Referring to FIGS. 1 through 3 and 22, the winding stem 110 has a corner portion and a guide shaft portion. A rectangular hole of a clutch wheel 114 is incorporated into the corner portion of the winding stem 110. The clutch wheel 114 has the same rotation axis as that of the winding stem 110. The rectangular hole of the clutch wheel 114 is fit-engaged with the corner portion of the winding stem 110, whereby the clutch wheel 114 rotates based on the rotation of the winding stem 110. The clutch wheel 114 has teeth A 114A and teeth B 114B. The teeth A 114A are provided at the end portion of the clutch wheel 114 nearer to the center of the movement. The teeth B 114B are provided at the end portion of the clutch wheel 114 farther from the center of the movement.

A winding pinion 116 is rotatably provided on the guide shaft portion of the winding stem 110. The winding pinion 116 has inner teeth 116A and outer teeth 116B. When the winding stem 110 is at a first winding stem position (0th step) nearest to the inner side of the movement in the rotation axis direction, the teeth B 114*b* of the clutch wheel 114 are in mesh with the inner teeth 116A of the winding pinion 116. In this state, when the winding stem 110 is rotated, the winding pinion 116 rotates via the rotation of the clutch wheel 114. In the state in which the winding stem 110 is at the "1st step" and the "2nd step," the teeth B 114B of the clutch wheel 114 are out of mesh with the inner teeth 116A of the winding pinion 116.

The setting lever 120 is rotatably arranged on the back side of the main plate 102. The yoke 122 is rotatably arranged on the back side of the main plate 102. The yoke 122 is urged by the spring force of a yoke spring portion 122A so as to be pressed against the forward end portion of the setting lever 120. The yoke holder 124 is provided so as to hold the setting lever 120 and the yoke 122. A setting lever positioning pin provided on the setting lever 120 is engaged with a setting lever positioning chevron portion of the yoke holder 124, and positioning is effected on the setting lever 120 at three positions in the rotating direction by the yoke holder 124.

A winding stem guide portion of the setting lever 120 is engaged with a step portion of the winding stem 110, and the position of the winding stem 110 in the rotation axis direction is determined based on the rotation of the setting lever 120. A clutch wheel guide portion of the yoke 122 is engaged with a step portion of the clutch wheel 114, and the position of the clutch wheel 114 in the rotation axis direction is determined based on the rotation of the yoke 122. Based on the rotation of the setting lever 120, positioning is effected on the yoke 122 at two positions in the rotating direction.

In the state in which the winding stem 110 is at the "0th step," the clutch wheel 114 is at a first position nearer to the outer side of the movement, and, in the state in which the winding stem 110 is at the "1st step" and the "2nd step," the clutch wheel 114 is at a second position which is nearer to the inner side of the movement.

The setting lever 120, the yoke 122, and the yoke holder 124 constitute the switching device of the watch. The setting lever 120 and the setting lever positioning chevron portion of the yoke holder 124 constitute a winding stem positioning means determining the position of the winding stem 110 in the rotation axis direction. The yoke 122 constitutes a clutch wheel positioning means that is operated based on the operation of the setting lever 120 and the yoke holder 124.

A setting wheel pin 102C constituting the rotation center of a setting wheel 128 is provided on the back side of the main plate 102 and in the rotation axis of the winding stem 110. The setting wheel 128 is rotatably incorporated into the setting wheel pin 102C. In the state in which the winding stem 110 is at the "0th step," the setting wheel 128 is out of mesh with the teeth A 114A of the clutch wheel 114, and, in the state in which the winding stem 110 is at the "1st step" and the "2nd step," it is in mesh with the teeth A 114A of the clutch wheel 114.

(1.4) Construction of the Correction Device

Figure 22:
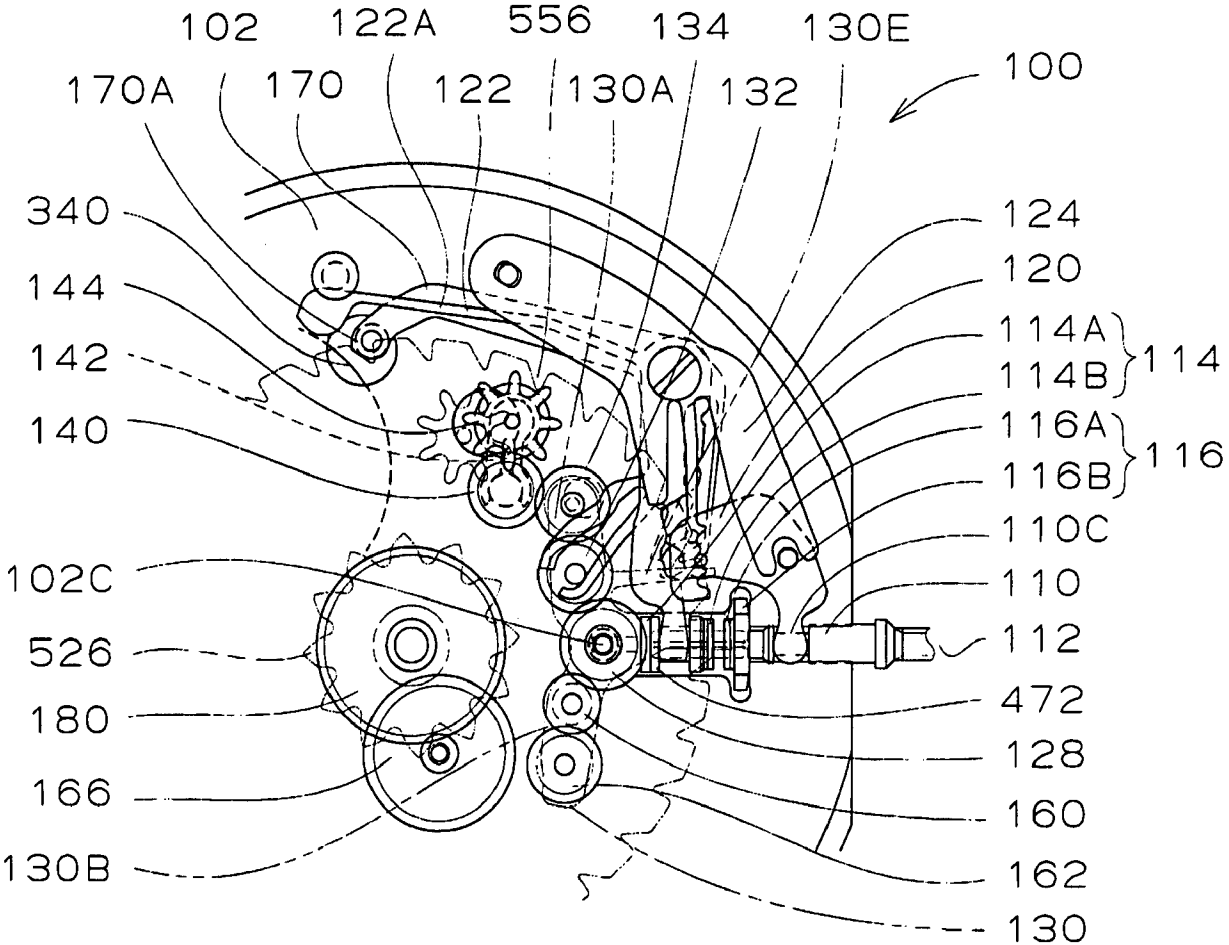
FIG. 22 is a partial plan view of a switching mechanism and a correction mechanism in the watch with a calendar mechanism of the first embodiment of the present invention.

Referring to FIG. 22, a rocking bar 130 is provided so as to be rockable around the setting wheel pin 102C. A rocking bar stop frame 136 is fitted onto the top portion of the setting wheel pin 102C. The rocking bar stop frame (not shown) is provided in order to rockably hold the rocking bar 130. The rocking bar stop frame may be fixed to the top portion of the setting wheel pin 102C, or the rocking bar stop frame may be arranged on the top portion of the setting wheel pin 102C.

The rocking bar 130 has a rocking bar first portion 130A arranged on one side of the setting wheel pin 102C, that is, in the 1 o'clock direction with respect to the center axis (reference axis) of the winding stem 110, and a rocking bar second portion 130B arranged on the other side of the setting wheel pin 102C, that is, in the 5 o'clock direction with respect to the center axis (reference axis) of the winding stem 110. The rocking bar 130 includes a setting lever engagement portion 130E. The setting lever engagement portion 130E of the rocking bar 130 is preferably formed as a spring capable of elastic deformation.

A first correction transmission wheel 132 is rotatably mounted to the rocking bar first portion 130A. A second correction transmission wheel 134 is rotatably mounted to the rocking bar first portion 130A. The first correction transmission wheel 132 is in mesh with the setting wheel 128 and the second correction transmission wheel 134. The first correction transmission wheel 132 has a first correction transmission wheel shaft portion (not shown).

The second correction transmission wheel 134 has a second correction transmission wheel shaft portion (not shown). A rocking bar positioning hole (not shown) is provided in the main plate 102. The second correction transmission wheel shaft portion is arranged in the rocking bar positioning hole. The position in the rotating direction of the rocking bar 130 is determined through abutment of the second correction transmission wheel shaft portion against a cylindrical wall surface of the rocking bar positioning hole. Thus, when the winding stem 110 is at the second winding stem position (1st step), the first correction transmission wheel 132 and the second correction transmission wheel 134 constitute a first correction train wheel provided on the rocking bar 130 for correcting the display of a first date indicator 512 and a second date indicator 522 based on the rotation of the setting wheel 128.

While it is preferable for the number of correction transmission wheels constituting the first correction train wheel to be two, it may also be one, or three or more. A third correction transmission wheel 140 is rotatably provided on the main plate 102. A rocking lever 142 is provided so as to be rockable with respect to the third correction transmission wheel. The rocking lever 142 is mounted to the third correction transmission wheel 140 such that the third correction transmission wheel 140 can slip with respect to the rocking lever 142 when a fixed slip torque is exceeded. In an embodiment of the present invention, this slip torque is preferably set to 1 g·cm to 2 g·cm.

A correction wheel 144 is rotatably provided on the rocking lever 142. The correction wheel 144 has a correction pinion (not shown), a correction cogwheel (not shown), and a correction wheel shaft portion (not shown). The third correction transmission wheel 140 is in mesh with the second correction transmission wheel 134 and the correction pinion. A rocking lever positioning hole (not shown) is provided in the main plate 102. The correction wheel shaft portion is arranged in the rocking lever positioning hole. The position in the rotating direction of the rocking lever 142 is determined through abutment of the correction wheel shaft portion against the cylindrical wall surface of the rocking lever positioning hole.

Figure 3:
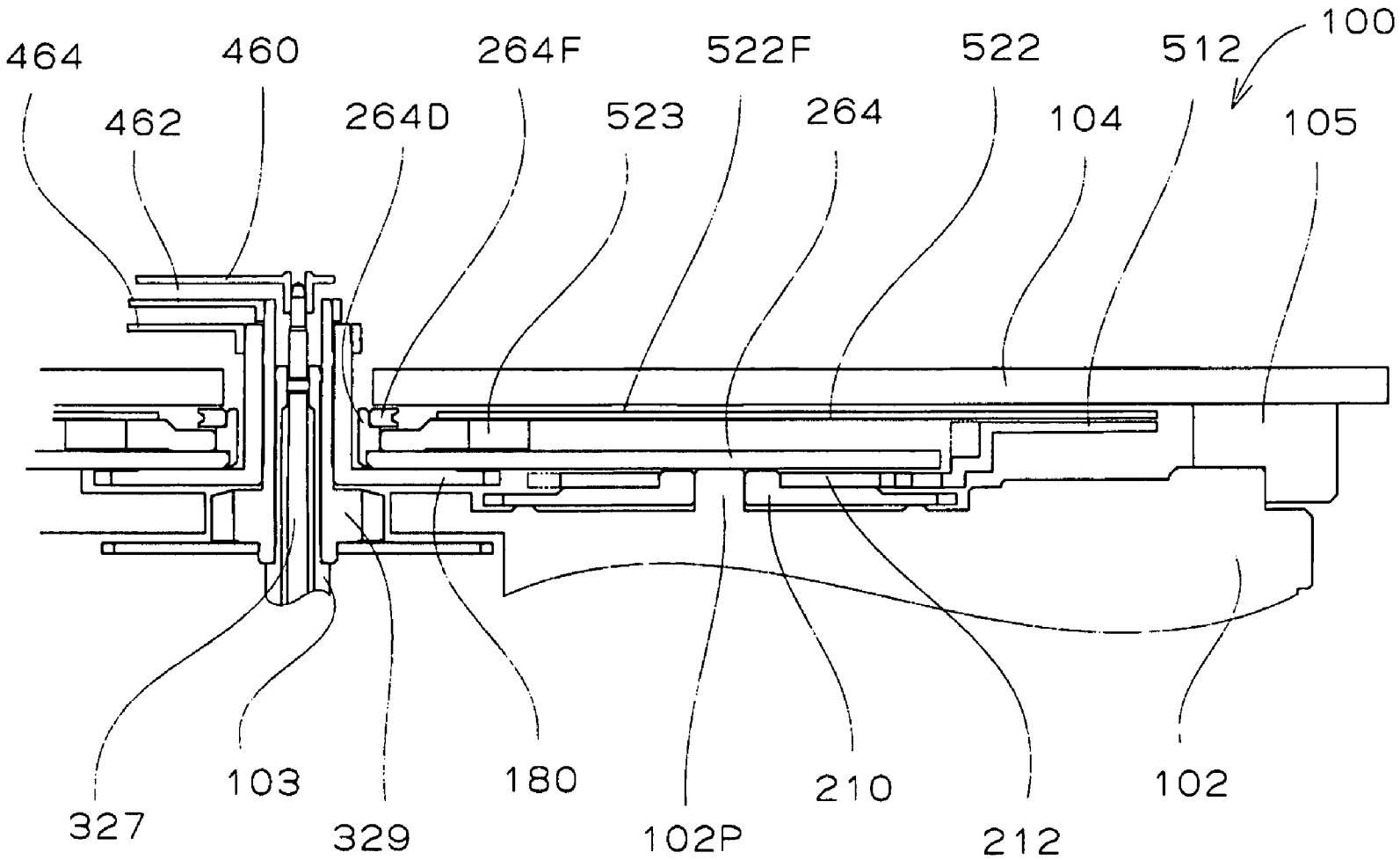
FIG. 3 is a partial sectional view of the structure of a front train wheel and of a part of the calendar mechanism in the watch with a calendar mechanism of the first embodiment of the present invention.

Referring to FIGS. 1 and 3, the first date indicator 512 for displaying the 1 place of a date is rotatably incorporated into the main plate 102. The first date indicator 512 has 31 date indicator teeth, and is rotated by a date feeding mechanism (described below). The position in the rotating direction of the first date indicator 512 is determined by a first date jumper 514. A date indicator maintaining plate 264 rotatably holds the first date indicator 512.

The second date indicator 522 for displaying the 10 place of a date is provided. The second date indicator 522 has a second date star 523 having 12 teeth. The second date star 523 is arranged so as to be rotatable with respect to a second date star guide pin 264D provided on the date indicator maintaining plate 264. The second date indicator 523 is supported by a second date indicator stop seat 264F so as to be rotatable with respect to the second date star guide pin 264D. The second date indicator 522 is rotated by a second date feeding mechanism (described below). The position in the rotating direction of the second date indicator 522 is determined by a second date jumper 524.

Referring to FIG. 22, a first minute wheel 160 is rotatably mounted to a rocking bar second portion 130B. A second intermediate minute wheel 162 is rotatably mounted to the rocking bar second portion 130B. A first intermediate minute wheel 160 is in mesh with the setting wheel 128 and the second intermediate minute wheel 162.

The first intermediate minute wheel 160 and the second intermediate minute wheel 162 constitute a second correction train wheel provided on the rocking bar 130 for correcting the display on the time display member through rotation of the minute wheel 166 based on the rotation of the setting wheel 128 when the winding stem 110 is at the third winding stem position (2nd step). While the number of intermediate minute wheels constituting the second correction train wheel is preferably two, it may also be one, or three or more.

Figure 2:
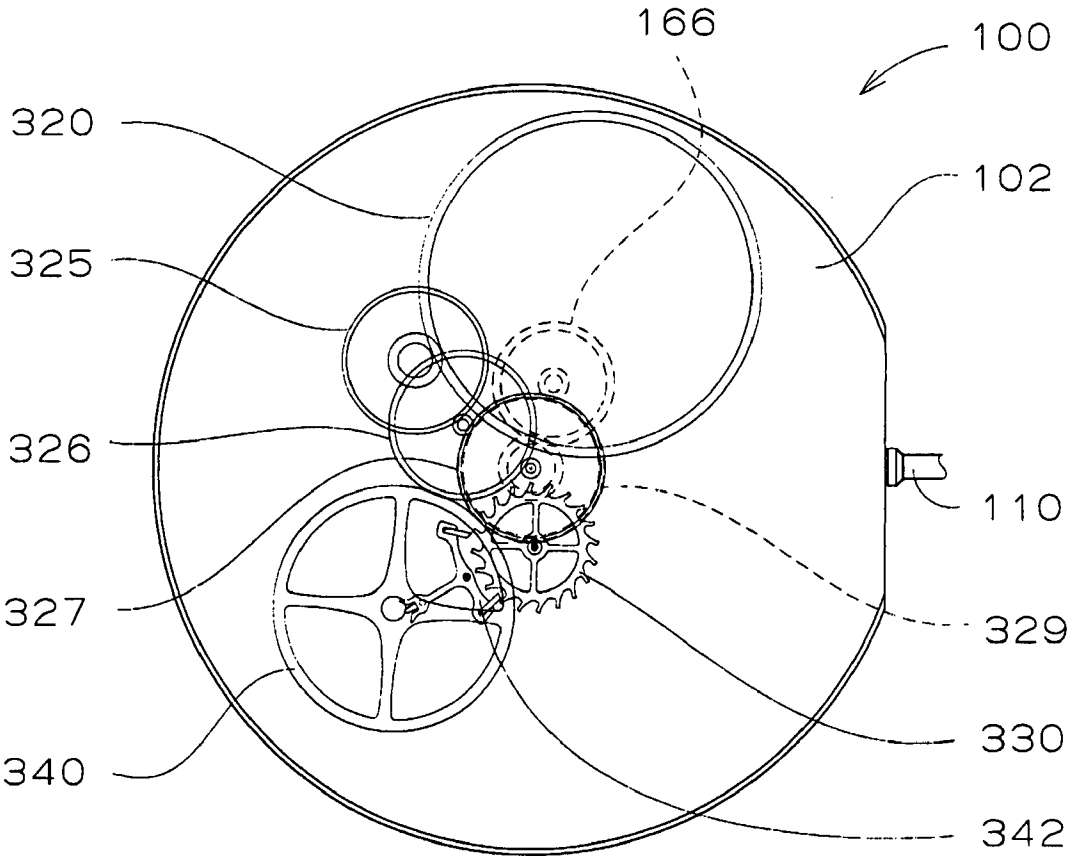
FIG. 2 is a schematic plan view of the structure of a train wheel when the movement is seen from the case back side in the watch with a calendar mechanism of the first embodiment of the present invention.

(1.5) Construction of the Setting Device:

Referring to FIGS. 2 and 22, a balance setting lever 170 for setting the operation of the time display member through operation based on the operation of the switching device, is provided so as to be rotatable around the rotation center of the yoke 122. When the winding stem 110 is at the 0th step and the 1st step, the balance setting lever 170 is rotated clockwise by the setting lever 120, and a rocking bar abutment portion (not shown) of the balance setting lever 170 abuts the first correction transmission wheel shaft portion to effect positioning.

The balance setting lever 170 pushes the first correction transmission wheel shaft portion, whereby the rocking bar 130 is rotated clockwise. As described above, the position in the rotating direction of the rocking bar 130 is determined when the rocking bar 130 rotates clockwise and the second correction transmission wheel shaft portion comes into contact with the cylindrical wall surface of the rocking bar positioning hole. When the winding stem 110 is at the "0th step" and the "1st" step, the balance setting pin 170A of the setting lever 170 does not come into contact with the balance with hairspring 340. When the winding stem 110 is at the third winding stem position (2nd step), the balance setting pin 170A of the setting lever 170 comes into contact with the balance with hairspring 340.

(1.6) Construction of the Calendar Mechanism:

(1.6.1) Construction of the First Date Indicator Feeding Mechanism:

In the following the construction of the first date indicator feeding mechanism will be described. With reference to FIGS. 1 through 3 and 21, in the movement 100, the date feeding mechanism includes a first intermediate date wheel 265, a second intermediate date wheel 266, a date indicator driving wheel 210, and a first date jumper 514. Through rotation of the hour wheel 180, the first intermediate date wheel 265 is rotated. Through the rotation of the first intermediate date wheel 265, the second intermediate date wheel 266 is rotated. Through the rotation of the second intermediate date wheel 266, the date indicator driving wheel 210 is rotated. The hour wheel 180 makes one rotation every 12 hours. The date indicator driving wheel 210 makes one rotation every 24 hours.

The first date indicator 512 is rotatably incorporated into the main plate 102. The first date jumper for setting the position in the rotating direction of the first date indicator 512 is incorporated into the main plate 102. The first date jumper 514 includes a spring portion 514B, and setting portions 514C, 514D provided at the forward end of the spring portion 514B. The setting portions 514C, 514D of the first date jumper 514 are constructed so as to set the tooth portion of the first date indicator 512. When the date indicator driving wheel 210 makes one rotation, the first date indicator 512 is rotated by one pitch (one tooth).

A date feeding finger 212 for feeding a first date indicator tooth portion 556 of the first date indicator 512 is provided so as to rotate integrally through rotation of the date indicator driving wheel 210. The date feeding finger 212 includes a date feeding portion 213 provided at the forward end, and a date feeding finger spring portion 214. Through rotation of the date indicator driving wheel 210, the date feeding finger 212 is rotated, and, due to the date feeding finger 212, the first date indicator 512 can rotate counterclockwise intermittently once in 24 hours by 360/31 degrees.

Figure 21:
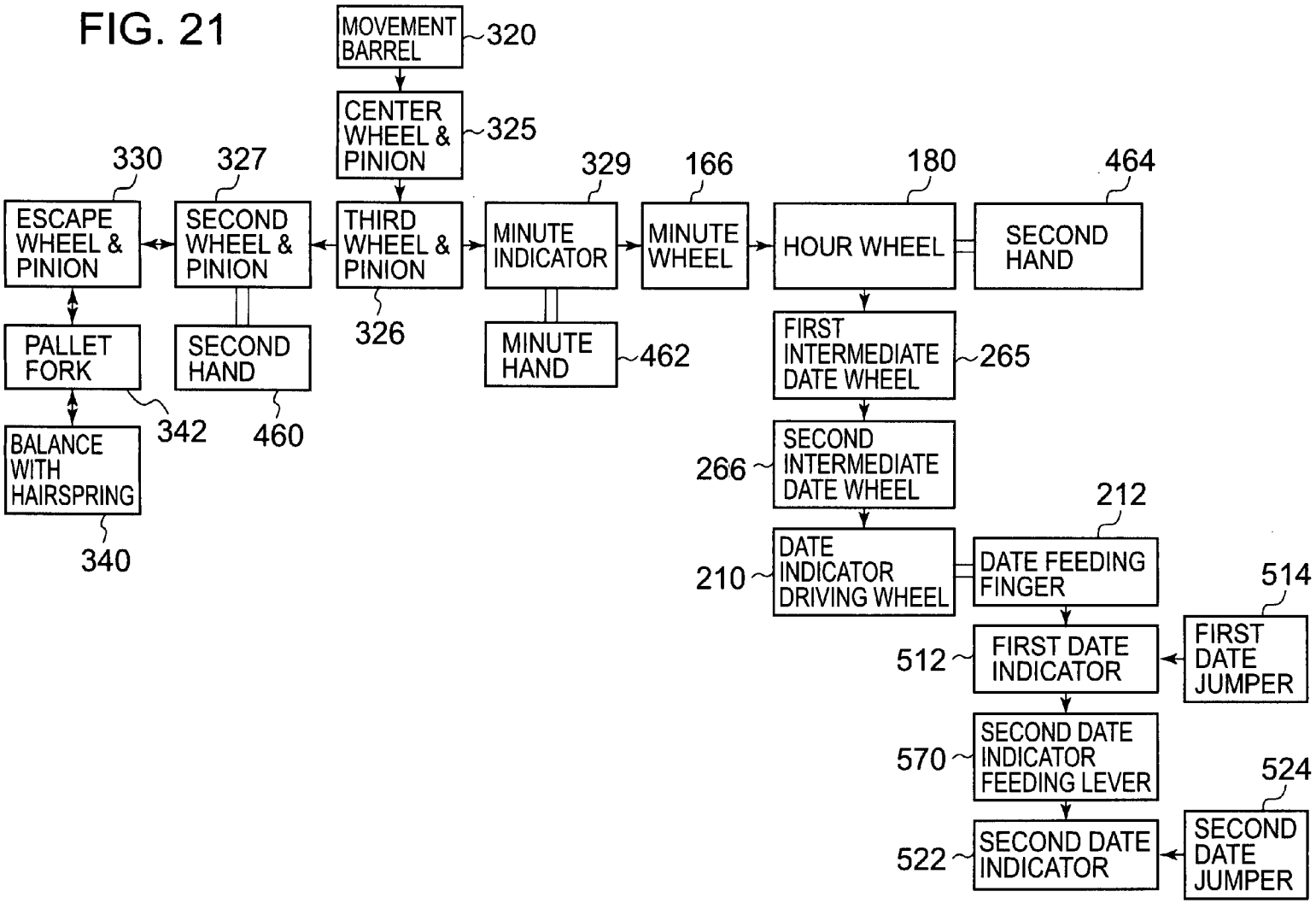
FIG. 21 is a block diagram showing a power mechanism, an escapement mechanism, a governing mechanism, a front train wheel, a calendar mechanism, etc. in the watch with a calendar mechanism of the first embodiment of the present invention.

(1.6.2) Construction of the Second Date Indicator Feeding Mechanism:

Next, the construction of the second date indicator feeding mechanism will be described. Referring to FIGS. 1, 3, and 21, a second date indicator feeding lever 570 is operably arranged between the second date indicator 522 and the date indicator maintaining plate 264. The second date indicator feeding lever 570 is arranged to face the upper surface of the date indicator maintaining plate 264. Two second date indicator feeding lever guide pins 571, 573 are provided on the date indicator maintaining plate 264 in order to operably guide and retain the second date indicator feeding lever 570. As shown in the drawings, it is desirable to provide two month feeding lever guide pins; however, the number of second date indicator feeding lever guide pins may also be three or more. Disc-like holding portions of the second date indicator feeding lever guide pins 571, 573 hold the second date indicator feeding lever 570 so as to face the upper surface of the date indicator maintaining plate 264. A second date jumper 524 for setting the position in the rotating direction of the second date indicator 522 is incorporated into the date indicator maintaining plate 264. The second date jumper 524 includes a spring portion 524B, and setting portions 524C, 524D provided at the forward end of the spring portion 524B. The setting portions 524C, 524D of the second date jumper 524 are constructed so as to set a positioning tooth portion 526 of the second date indicator 562.

The second date indicator feeding lever 570 includes a second date indicator feeding portion 570A arranged so as to be capable of coming into contact with the tooth portion of the second date star 523, an operation guide portion 570B arranged so as to be capable of coming into contact with the second date indicator feeding lever guide pin 573, a lever feeding operation portion 570C arranged so as to be capable of coming into contact with the calendar shift tooth 518 of the first date indicator 512, and a second date indicator feeding lever spring portion 570D. The portion of the second date indicator feeding lever spring portion 570D near the distal end thereof comes into contact with a second date indicator feeding lever spring pin 570F provided on the date indicator maintaining plate 264. The second date indicator feeding lever 570 is guided by the second date indicator feeding lever guide pins 571, 572 to move from a first position toward the second date indicator 522 based on the rotation of the first date indicator, and is restored to the former (first) position by the spring force of the second date indicator feeding lever spring portion 570D. The rotation center of the date indicator driving wheel 210 is formed by a date indicator driving wheel pin 102P provided on the main plate 102.

Figure 4:
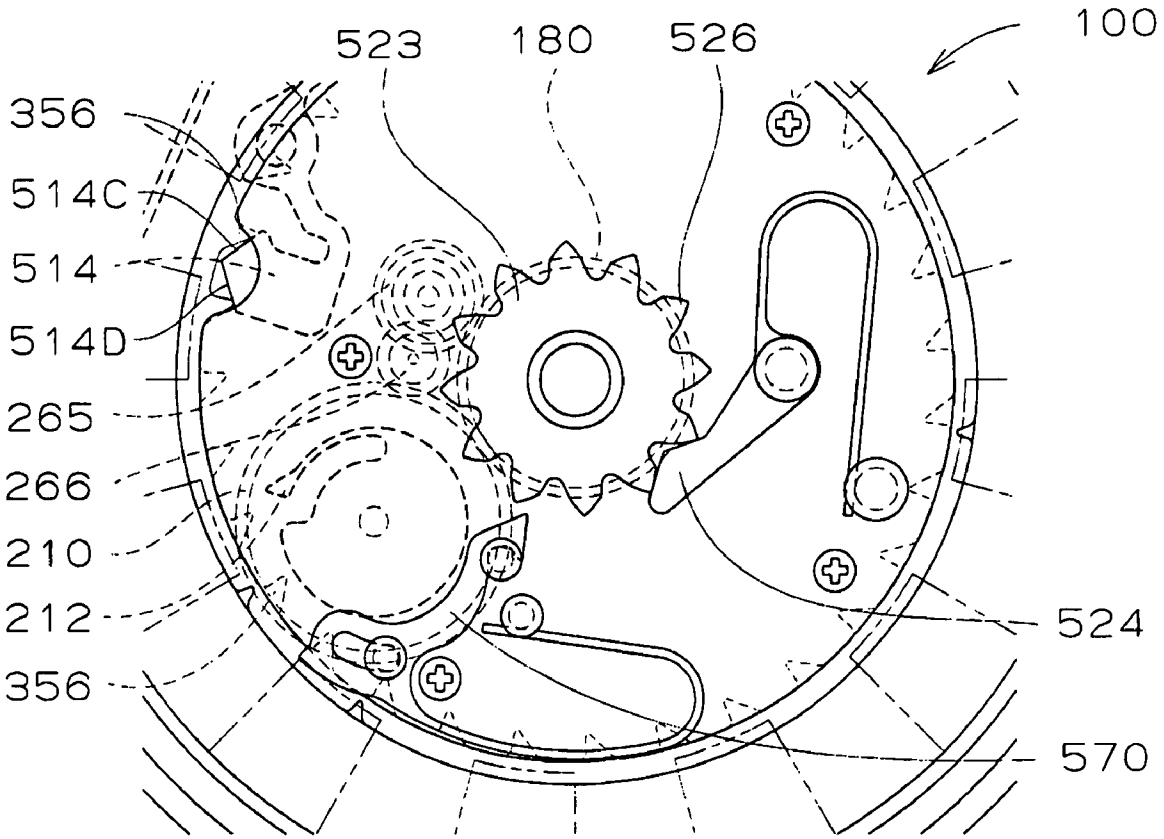
FIG. 4 is an enlarged partial plan view of the structure of a part of the calendar mechanism when the movement is seen from the dial side in the watch with a calendar mechanism of the first embodiment of the present invention.

(1.6.3) Construction of the First Date Indicator and the Second Date Indicator:

FIG. 4 is a partial plan view showing the back side construction of the movement as seen from the dial side in the state in which the first date indicator 512 is being caused to rotate counterclockwise. Referring to FIGS. 3, 4, and 21, the movement 100 is equipped with the first intermediate date wheel 265, the second intermediate date wheel 266, the date indicator driving wheel 210, the first date indicator 512 displaying the 1 place of a date, the first date jumper 514 for setting the position in the rotating direction of the first date indicator 512, the second date indicator 522 displaying the 10 place of a date, the second date jumper 524 for setting the position in the rotating direction of the second date indicator 522, and the second date indicator feeding lever 570 capable of moving based on the rotation of the first date indicator 512 and of rotating the second date indicator 522. The rotation center of the first date indicator 512 and the rotation center of the second date indicator 522 are at the same position. That is, the rotation center of the first date indicator 512 and the rotation center of the second date indicator 522 are arranged at the same position as the rotation center of an hour hand 464 (that is, the rotation center of the hour wheel 180). Setting portions 514C, 514D of the first date jumper 514 sets a first date indicator tooth portion 356 of the first date indicator 512.

Figure 5:
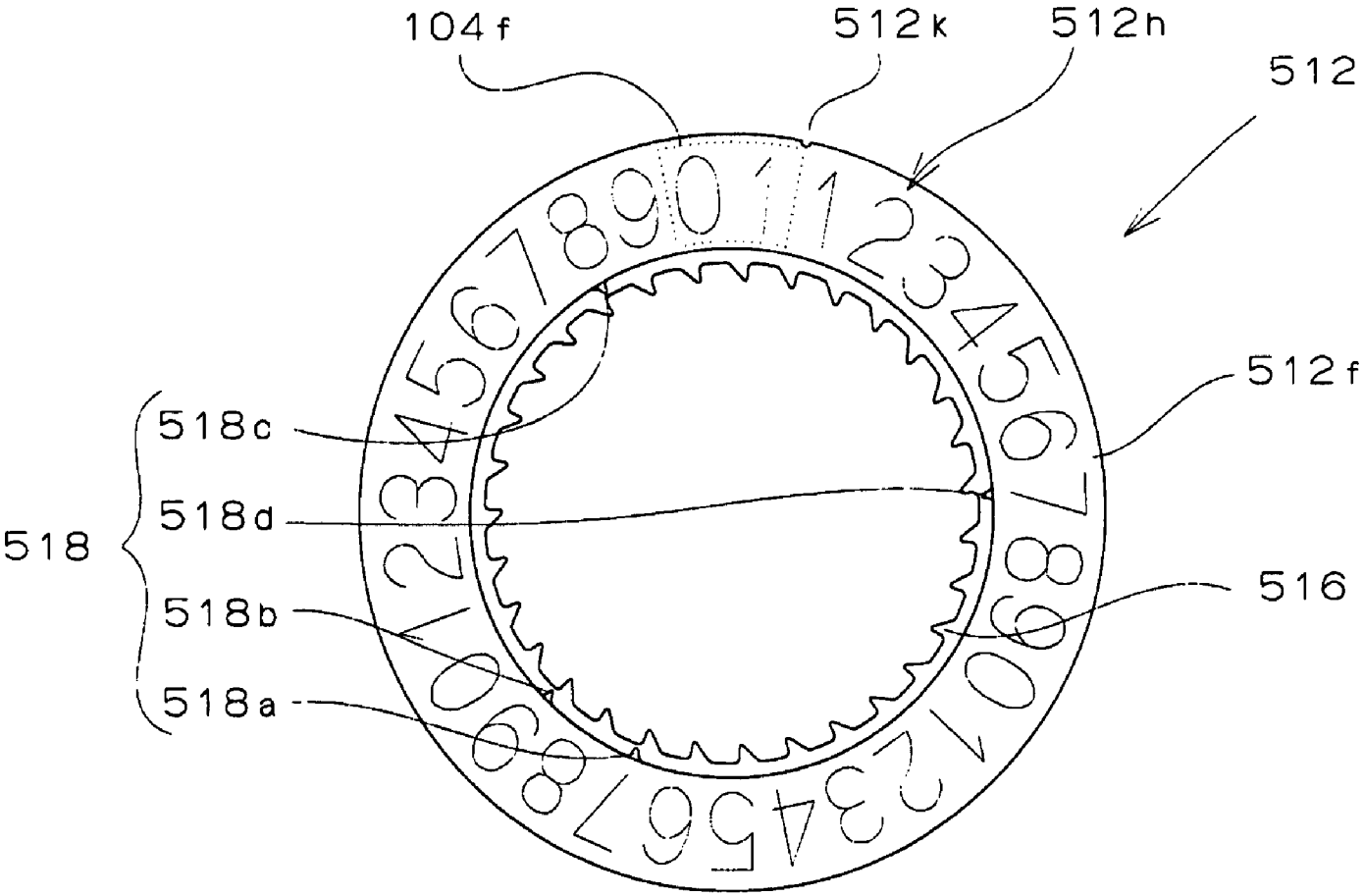
FIG. 5 is a plan view of a first date indicator in a construction in which a date window is arranged in the 12 o'clock direction of a dial in the watch with a calendar mechanism of the first embodiment of the present invention.

Referring to FIG. 5, in the case of a construction in which a date window 104*f* is formed at the 12 o'clock position of the dial 104, the first date indicator 512 is equipped with a ring-shaped first letter display surface 512*f*. The first date indicator 512 includes 31 first date indicator tooth portions 516 formed as inner teeth, and four calendar shift teeth 518 formed as inner teeth. The first date indicator tooth portions 516 are formed at equal angular intervals, that is, an interval of (360/31) degrees. The calendar shift teeth 518 comprise a first calendar shift tooth 518*a* serving as a reference, a second calendar shift tooth 518*b* formed clockwise at an interval of (360*2/31) degrees using the first calendar shift tooth 518*a* as a reference, a third calendar shift tooth 518*c* formed clockwise at an interval of (360*9/31) degrees using the second calendar shift tooth 518*b* as a reference, and a fourth calendar shift tooth 518*d* formed counterclockwise at an interval of (360*10/31) degrees using the first calendar shift tooth 518*a* as a reference.

First date letters 512*h* consisting of 31 numbers are provided on the first date letter display surface 512*f*. The first date letters 512*h* include four sets of numbers. That is, the first date letters include numbers "1" through "9" and "0" constituting the first set of first date letters, numbers "1" through "9" and "0" constituting the second set of first date letters, numbers "1" through "9" and "0" constituting the third set of first date letters, and the number "1" constituting the fourth set of first date letters. That is, the first date letters 312*h* include 31 numbers of "1," "1," "2," "3," "4," "5," "6," "7," "8," "9," "0," "1," "2," "3," "4," "5," "6," "7," "8," "9," "0," "1," "2," "3," "4," "5," "6," "7," "8," "9," and "0." The 31 numbers constituting the first date letters 512*h* are arranged on the first date letter display surface 512*f* at an equal angular interval, that is, at an interval of (360/31) degrees. In the state shown in FIG. 5, of the first date letters 512*h*, "0" and "1," which are adjacent to each other, are arranged in the date window 104*f* provided in the dial 104. In the outer peripheral portion of the first date letter display surface 512*f*, a cutout portion 512*k* is formed so as to correspond to the position between "1" and "1," arranged adjacent to each other, of the first date letters 512*h*.

Figure 6:
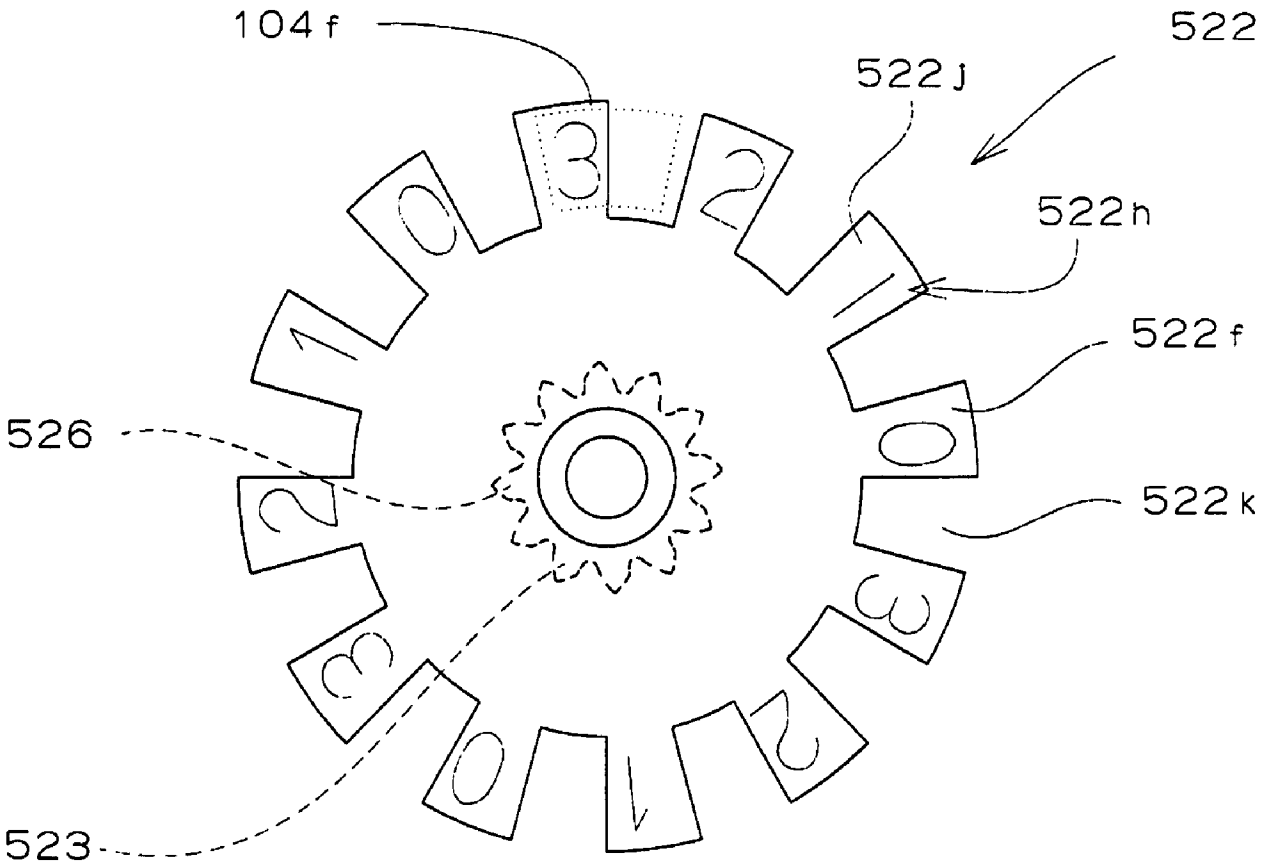
FIG. 6 is a plan view of a second date indicator in a construction in which a date window is arranged in the 12 o'clock direction of the dial in the watch with a calendar mechanism of the first embodiment of the present invention.

Referring to FIG. 6, the second date indicator 522 is equipped with a second date star 523 and a disc-like second date letter display surface 522*f* provided with a cutout. The second date letter display surface 522*f* includes twelve trapezoidal portions 522*j* formed at an interval of (360/12) degrees, and twelve cutouts 522*k* formed at an interval of (360/12) degrees. The second date star 523 of the second date indicator 522 includes twelve positioning tooth portions 526 formed as outer teeth. The positioning tooth portions 526 are formed at an equal angular interval, for example, at an interval of (360/12) degrees.

Second date letters 522*h* consisting of "1," "2," "3," and "0" are provided on the second date letter display surface 522*f*. The number "1" and the number "2" are arranged on the second date letter display surface 522*f* at an interval of 30 degrees. The number "2" and the number "3" are arranged on the second date letter display surface 522*f* at an interval of 30 degrees. The number "3" and the number "0" are arranged on the second date letter display surface 522*f* at an interval of 30 degrees. Thus, on the second date letter display surface 522*f*, the number "1," the number "2," the number "3," and the number "0" are arranged so as to be at a mutual interval of 30 degrees. On the second date letter display surface 522*f*, there are provided three sets of numbers consisting of the number "1," the number "2," the number "3," and the number "0." Alternatively, instead of providing the number "0," it is also possible to adopt a construction in which the portion at that position is formed as a "blank" portion (i.e., a portion where no number is provided). In the state shown in FIG. 6, the number "3" of the second date letters 522*h* is arranged in the left-hand side portion of the date window 104*f* provided in the dial 104.

Figure 7:
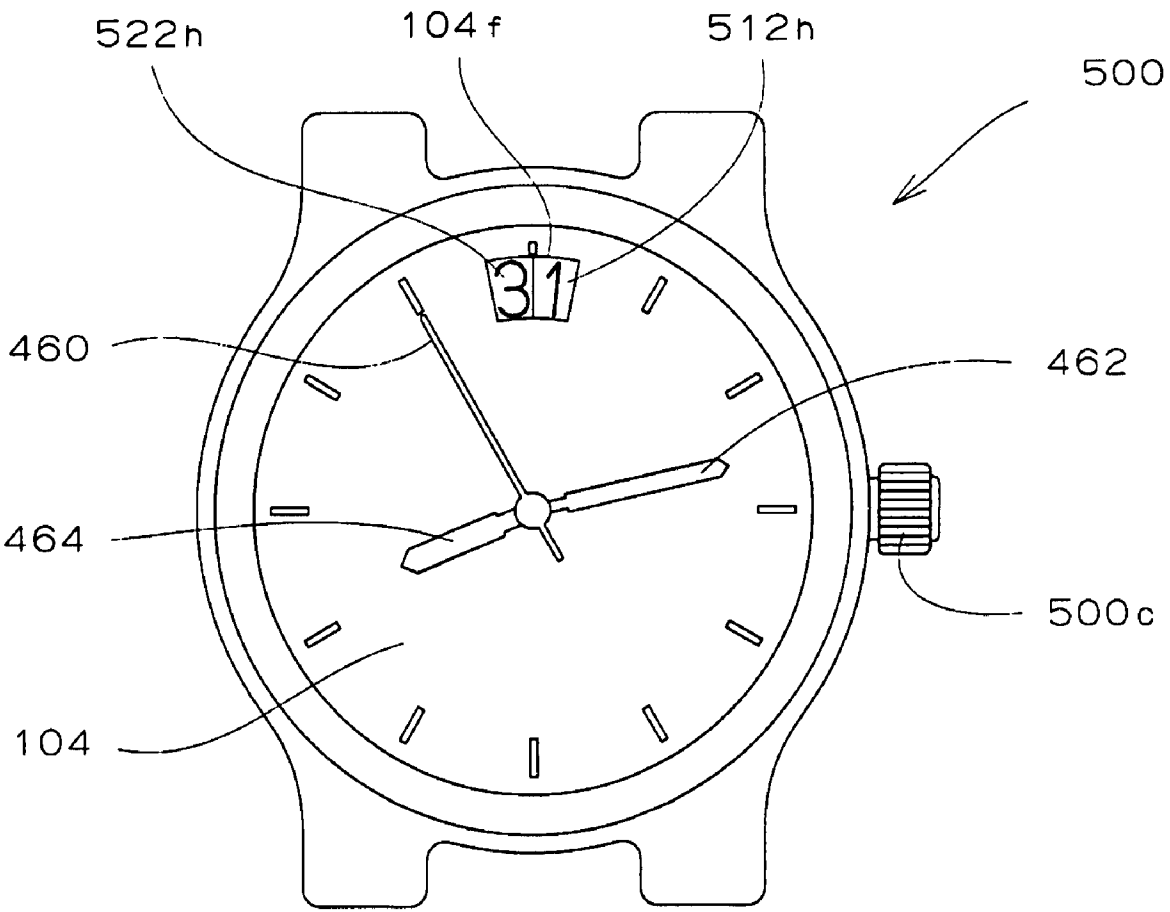
FIG. 7 is a plan view of a complete in a construction in which a date window is arranged in the 12 o'clock direction of the dial in the watch with a calendar mechanism of the first embodiment of the present invention.

Referring to FIG. 3, the second date letter display surface 522*f* is arranged at a position closer to the dial 104 than the first date letter display surface 512*f*. Referring to FIG. 7, in a complete 500 of the watch with a calendar mechanism of the present invention, the date window 104*f* is formed at the 12 o'clock position of the dial 104. In the complete 500, the number "3" of the second date letters 522*h* of the second date indicator 522 is arranged in the left-hand side portion of the date window 104*f* of the dial 104, and, the cutout portion 522*k* of the second date indicator 522 and the number "1" of the first date letters 512*h* are arranged in the right-hand side portion of the date window 104*f*. Thus, the complete 500 displays the "31st" day.

Figure 8:
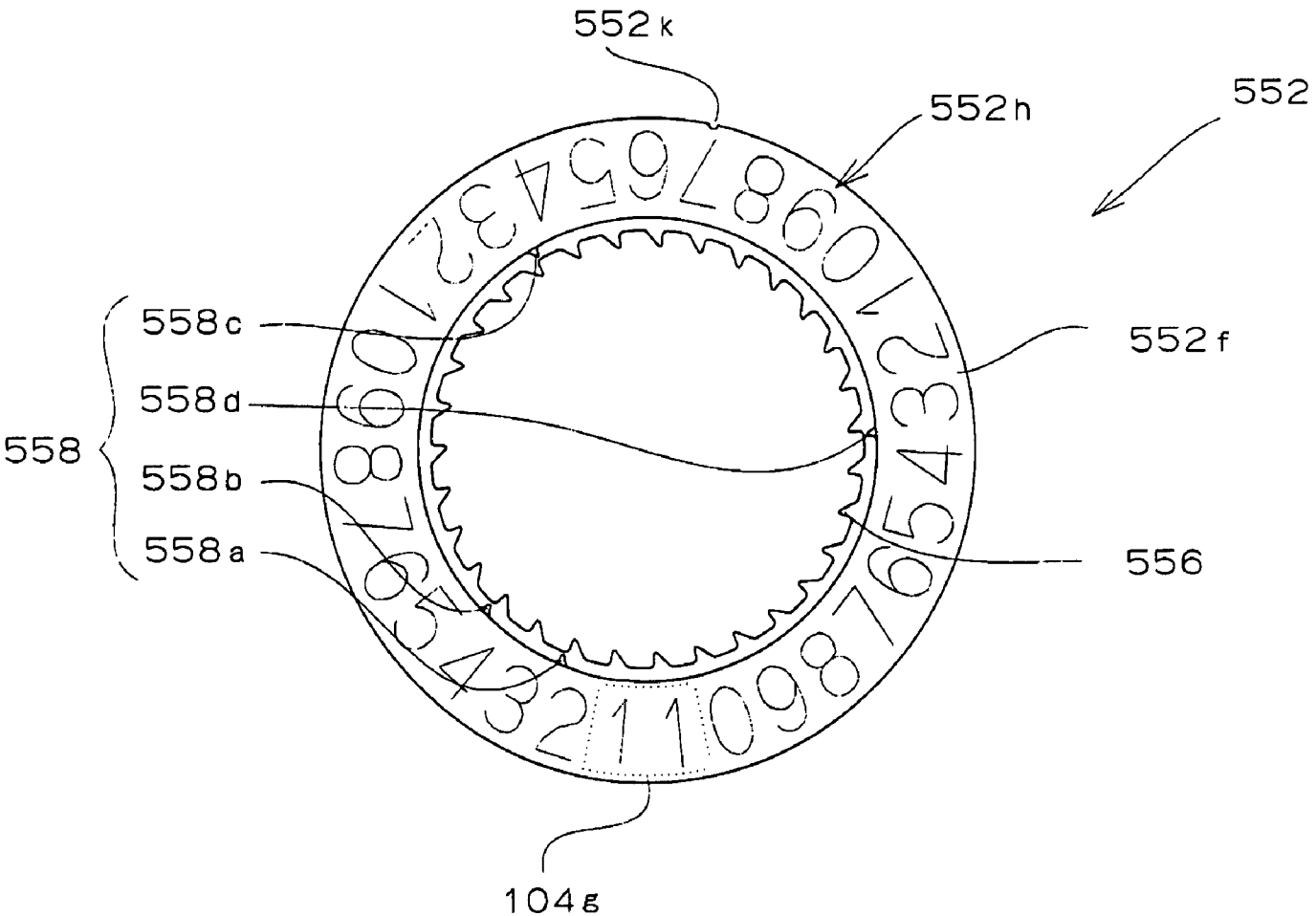
FIG. 8 is a plan view of the first date indicator in a construction in which a date window is arranged in the 6 o'clock direction of the dial in the watch with a calendar mechanism of the first embodiment of the present invention.

Referring to FIG. 8, in the case in which the date window 104*g* is formed at the 6 o'clock position of the dial 104, the first date indicator 552 is equipped with a ring-shaped first date letter display surface 552*f*. The first date indicator 552 includes 31 first date indicator tooth portions 556 formed as inner teeth, and four calendar shift teeth 558 formed as inner teeth. The first date indicator tooth portions 556 are formed at equal angular intervals, that is, at an interval of (360/31) degrees. The calendar shift teeth 558 consist of a first calendar shift tooth 558*a* serving as a reference, a second calendar shift tooth 558*b* formed clockwise at an interval of (360*2/31) degrees using the first calendar shift tooth 558*a* as a reference, a third calendar shift tooth 558*c* formed clockwise at an interval of (360*9/31) degrees using the second calendar shift tooth 558*b* as a reference, and a fourth calendar shift tooth 558*d* formed counterclockwise at an interval of (360*10/31) degrees using the first calendar shift tooth 558*a* as a reference.

First date letters 352*h* consisting of 31 numbers are provided on the first date letter display surface 552*f*. The first date letters 552*h* include four sets of numbers. That is, the first date letters include the numbers "1" through "9" and "0" constituting a first set of first date letters, the numbers "1" through "9" and "0" constituting a second set of first date letters, the numbers "1" through "9" and "0" constituting a third set of first date letters, and the number "1" constituting a fourth set of first date letters. The 31 numbers constituting the first date letters 552*h* are arranged on the first date letter display surface 552*f* at equal angular intervals, that is, at an interval of (360/31) degrees. In the state shown in FIG. 8, of the first date letters 552*h*, "1" and "1," which are arranged adjacent to each other, are arranged in the date window 104*g* provided in the dial 104. In the outer peripheral portion of the first date letter display surface 552*f*, a cutout portion 552*k* is formed so as to be in correspondence with the position of "7," which is opposite the center of the first date indicator 552 with respect to "1" and "1," which are arranged adjacent to each other, of the first date letters 552*h*.

Figure 9:
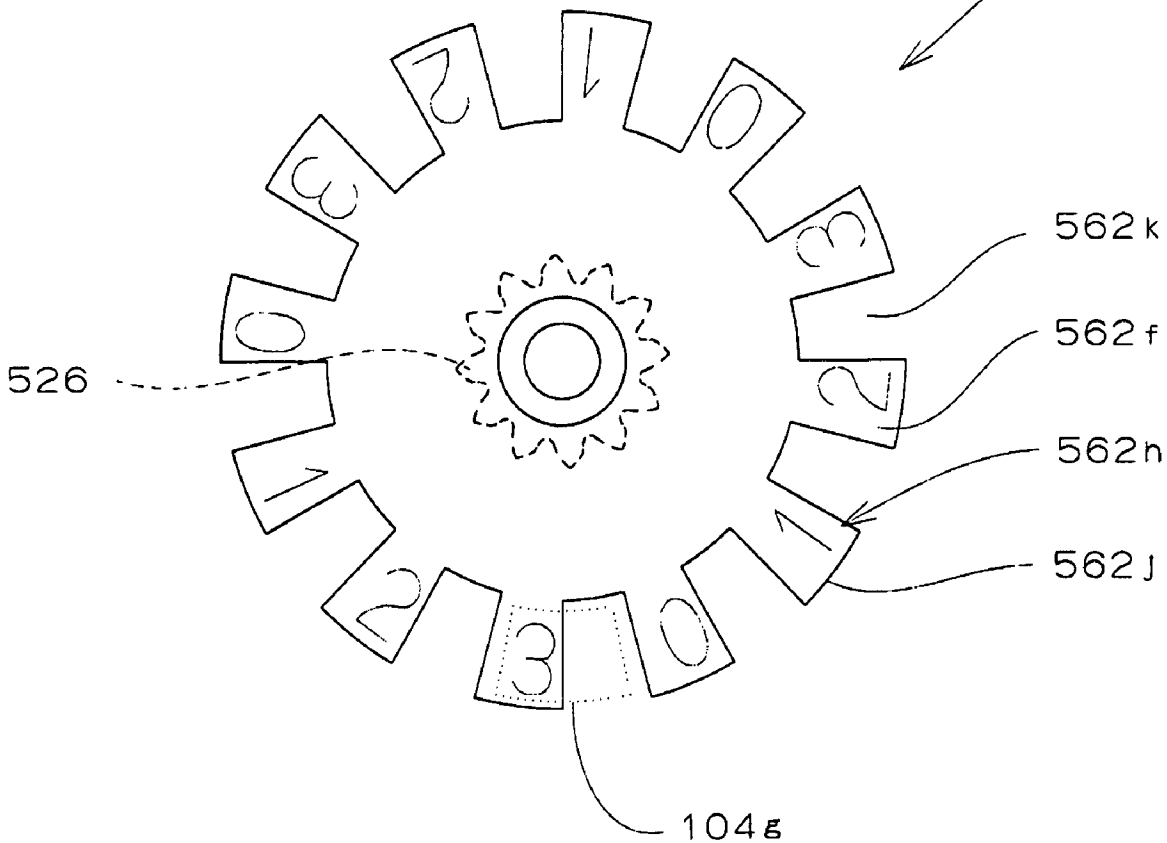
FIG. 9 is a plan view of the second date indicator in a construction in which a date window is arranged in the 6 o'clock direction of the dial in the watch with a calendar mechanism of the first embodiment of the present invention.

Referring to FIG. 9, the second date indicator 562 is equipped with a disc-like second date letter display surface 562*f* provided with a cutout. The second date letter display surface 562*f* includes twelve trapezoidal portions 562*j* formed at an interval of (360/12) degrees, and twelve cutout portions 562*k* formed at an interval of (360/12) degrees. The second date indicator 562 further includes twelve positioning tooth portions 526 formed as outer teeth. The positioning tooth portions 526 of the second date indicator 562 are formed at equal angular intervals, for example, at an interval of (360/12) degrees. Second date letters 562*h* consisting of the numbers "1," "2," "3," and "0" are provided on the second date display surface 562*f*. The numbers "1" and "2" are arranged on the second date letter display surface 562*f* at an interval of 30 degrees. The numbers "2" and "3" are arranged on the second date letter display surface 562*f* at an interval of 30 degrees. The numbers "3" and "0" are arranged on the second date letter display surface 562*f* at an interval of 30 degrees. Thus, on the second date letter display surface 562*f*, the number "1," the number "2," the number "3," and the number "0" are arranged at a mutual interval of 30 degrees. On the second date letter display surface 562*f*, there are provided three sets of numbers consisting of the number "1," the number "2," the number "3," and the number "0." Alternatively, instead of providing the number "0," it is also possible to adopt a construction in which the portion at that position is formed as a "blank" portion (that is, a portion where no number is provided). In the state shown in FIG. 9, the number "3" of the second date letters 562*h* is arranged in the left-hand side portion of the date window 104*g* provided in the dial 104.

Figure 10:
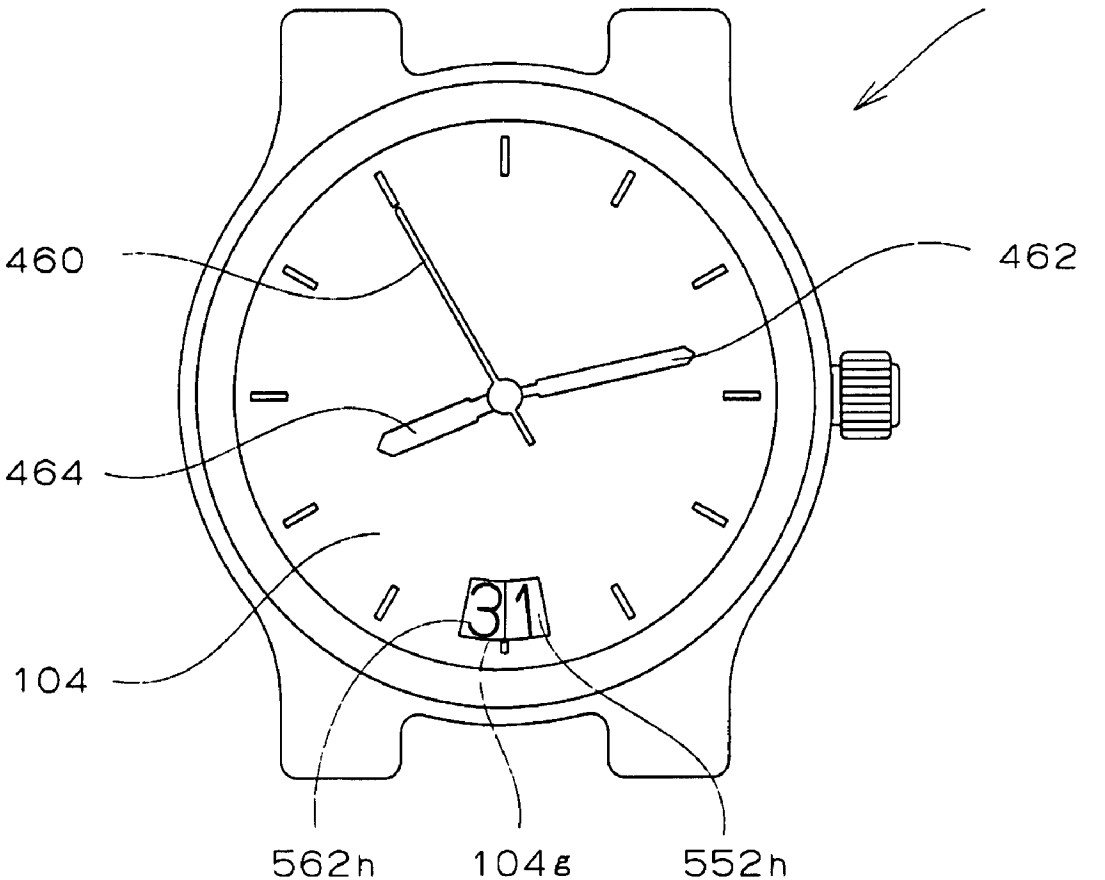
FIG. 10 is a plan view of the complete in a construction in which a date window is arranged in the 6 o'clock direction of the dial in the watch with a calendar mechanism of the first embodiment of the present invention.

Referring to FIG. 10, in a complete 550 of the watch with a calendar mechanism of the present invention, the date window 104*g* is formed at the 6 o'clock position of the dial 104. In the complete 550, the number "3" of the second date letters 562*h* of the second date indicator 562 is arranged in the left-hand side portion of the date window 104*g* of the dial 104, and, a cutout portion 562*k* of the second date indicator 562 and the number "1" of the first date letters 552*h* are arranged in the right-hand side portion of the date window 104*g*. Thus, the complete 550 displays the "31st" day.

Figure 11:
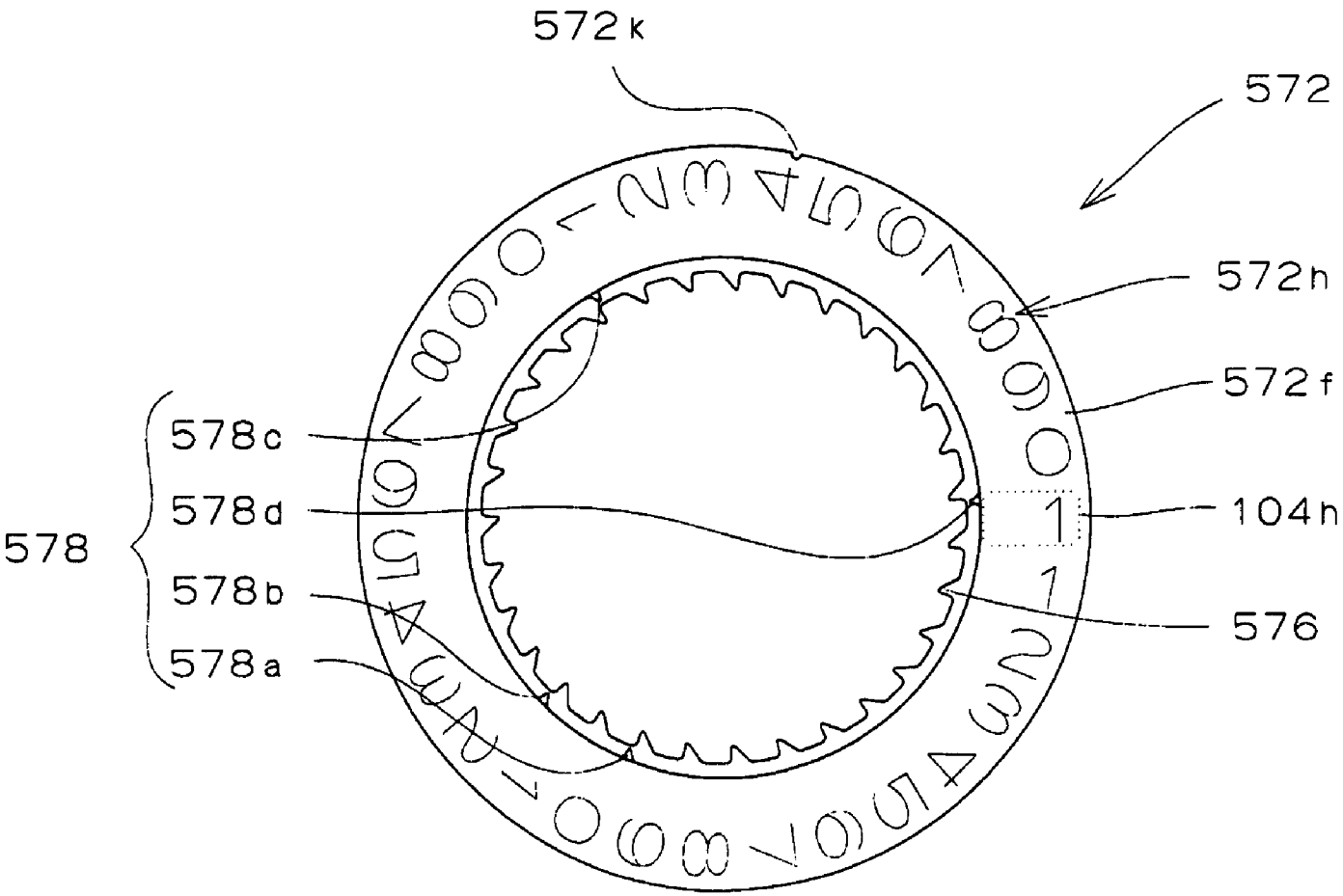
FIG. 11 is a plan view of the first date indicator in a construction in which a date window is arranged in the 3 o'clock direction of the dial in the watch with a calendar mechanism of the first embodiment of the present invention.

Referring to FIG. 11, in the case in which the date window 104*h* is formed at the 3 o'clock position of the dial 104, the first date indicator 572 is equipped with a ring-shaped first date letter display surface 572*f*. The first date indicator 572 includes 31 first date indicator tooth portions 576 formed as inner teeth, and four calendar shift teeth 578 formed as inner teeth. The first date indicator tooth portions 576 are formed at equal angular intervals, that is, at an interval of (360/31) degrees. The calendar shift teeth 578 consist of a first calendar shift tooth 578*a* serving as a reference, a second calendar shift tooth 578*b* formed clockwise at an interval of (360*2/31) degrees using the first calendar shift tooth 578*a* as a reference, a third calendar shift tooth 578*c* formed clockwise at an interval of (360*9/31) degrees using the second calendar shift tooth 578*b* as a reference, and a fourth calendar shift tooth 578*d* formed counterclockwise at an interval of (360*10/31) degrees using the first calendar shift tooth 578*a* as a reference.

First date letters 572*h* consisting of 31 numbers are provided on the first date letter display surface 572*f*. The first date letters 572*h* include four sets of numbers. That is, the first date letters include the numbers "1" through "9" and "0" constituting a first set of first date letters, the numbers "1" through "9" and "0" constituting a second set of first date letters, the numbers "1" through "9" and "0" constituting a third set of first date letters, and the number "1" constituting a fourth set of first date letters. The 31 numbers constituting the first date letters 572*h* are arranged on the first date letter display surface 572*f* at equal angular intervals, that is, at an interval of (360/31) degrees. In the state shown in FIG. 11, of the first date letters 572*h*, "1" is arranged in the date window 104*h* provided in the dial 104. In the outer peripheral portion of the first date letter display surface 572*f*, a cutout portion 572*k* is formed so as to be in correspondence with the position of "4," which is at a counterclockwise position with respect to "1" and "1," which are arranged adjacent to each other, of the first date letters 572*h*.

Figure 12:
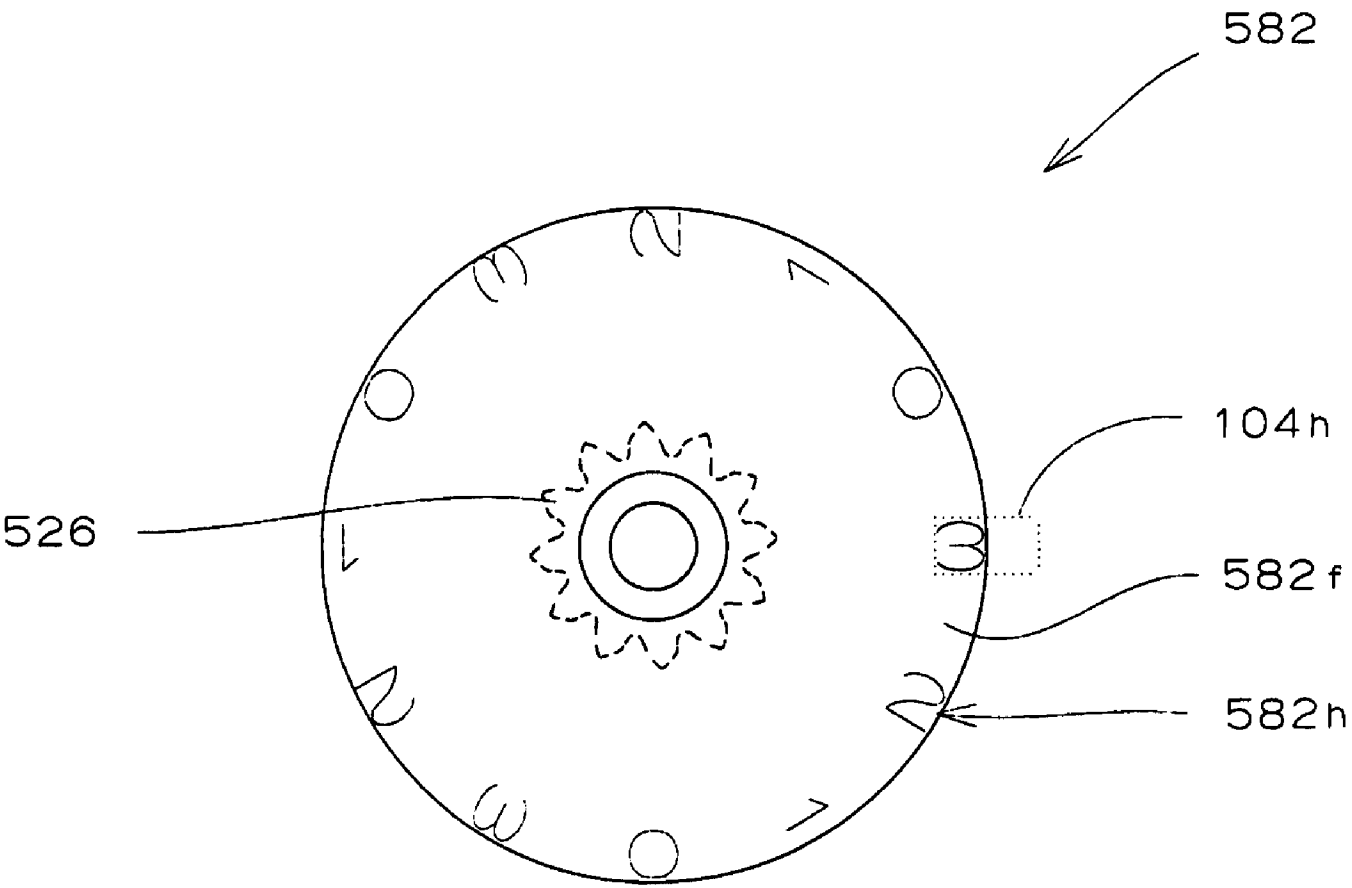
FIG. 12 is a plan view of the second date indicator in a construction in which a date window is arranged in the 3 o'clock direction of the dial in the watch with a calendar mechanism of the first embodiment of the present invention.

Referring to FIG. 12, the second date indicator 582 is equipped with a disc-like second date letter display surface 582*f*. The outer diameter of the second date letter display surface 582*f* is smaller than the size of the region of the first date letter display surface 572*f* where the date letters are arranged. The second date indicator 582 includes twelve positioning tooth portions 526 formed as outer teeth. The positioning tooth portions 526 are formed at equal angular intervals, for example, at an interval of (360/12) degrees. Second date letters 582*h* consisting of the numbers "1," "2," "3," and "0" are provided on the second date display surface 582*f*. The numbers "1" and "2" are arranged on the second date letter display surface 582*f* at an interval of 30 degrees. The numbers "2" and "3" are arranged on the second date letter display surface 582*f* at an interval of 30 degrees. The numbers "3" and "0" are arranged on the second date letter display surface 582*f* at an interval of 30 degrees. Thus, on the second date letter display surface 582*f*, the number "1," the number "2," the number "3," and the number "0" are arranged at a mutual intervals of 30 degrees. On the second date letter display surface 582*f*, there are provided three sets of numbers consisting of the number "1," the number "2," the number "3," and the number "0." Alternatively, instead of providing the number "0," it is also possible to adopt a construction in which the portion at that position is formed as a "blank" portion (that is, a portion where no number is provided). In the state shown in FIG. 12, the number "3" of the second date letters 382*h* is arranged in the left-hand side portion of the date window 104*h* provided in the dial 104.

Figure 13:
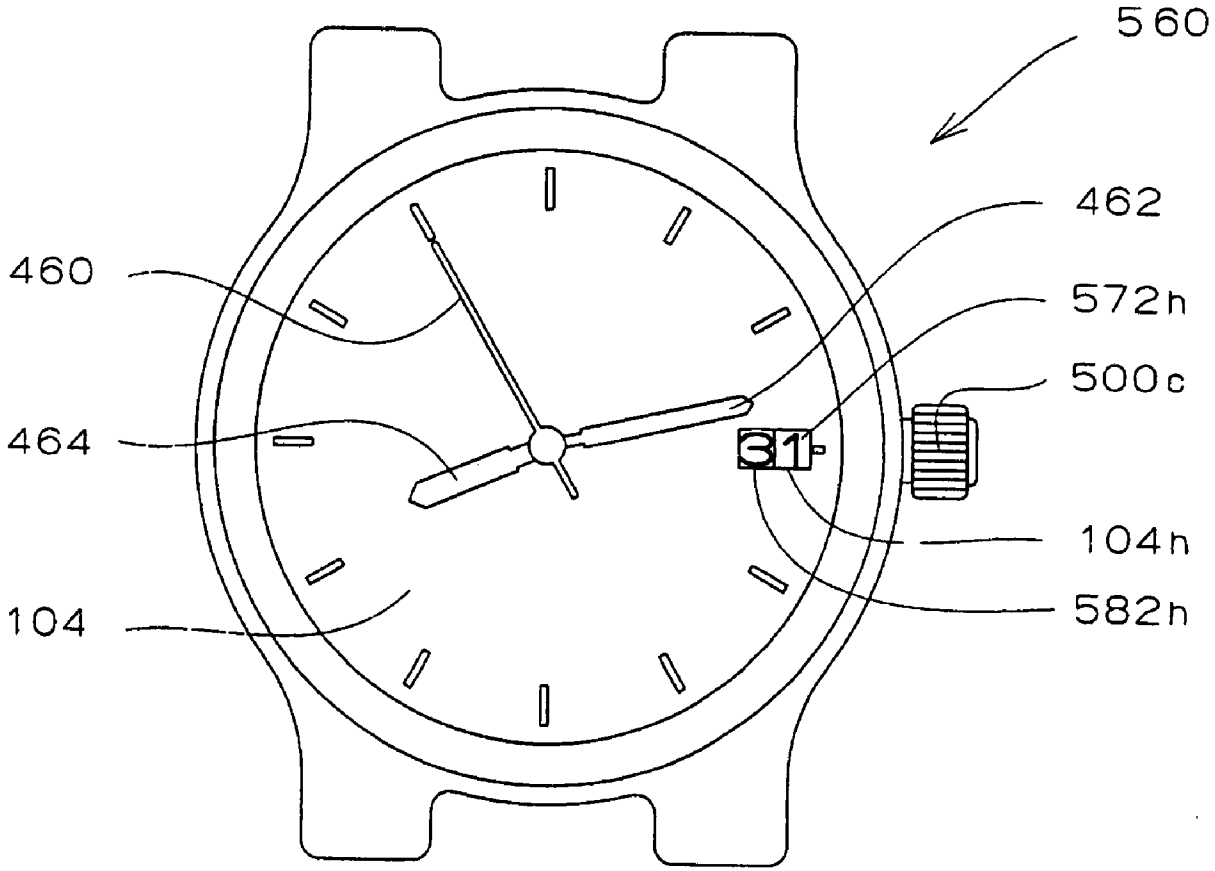
FIG. 13 is a plan view of the complete in a construction in which a date window is arranged in the 3 o'clock direction of the dial in the watch with a calendar mechanism of the first embodiment of the present invention.

Referring to FIG. 13, in a complete 560 of the watch with a calendar mechanism of the present invention, the date window 104*h* is formed at the 3 o'clock position of the dial 104. In the complete 560, the number "3" of the second date letters 582*h* of the second date indicator 582 is arranged in the left-hand side portion of the date window 104*h* of the dial 104, and, there is no second date indicator 562 in the right-hand side portion of the date window 104*h*, and the number "1" of the first date letters 572*h* is arranged there. Thus, the complete 560 displays the "31st" day.

Figure 14:
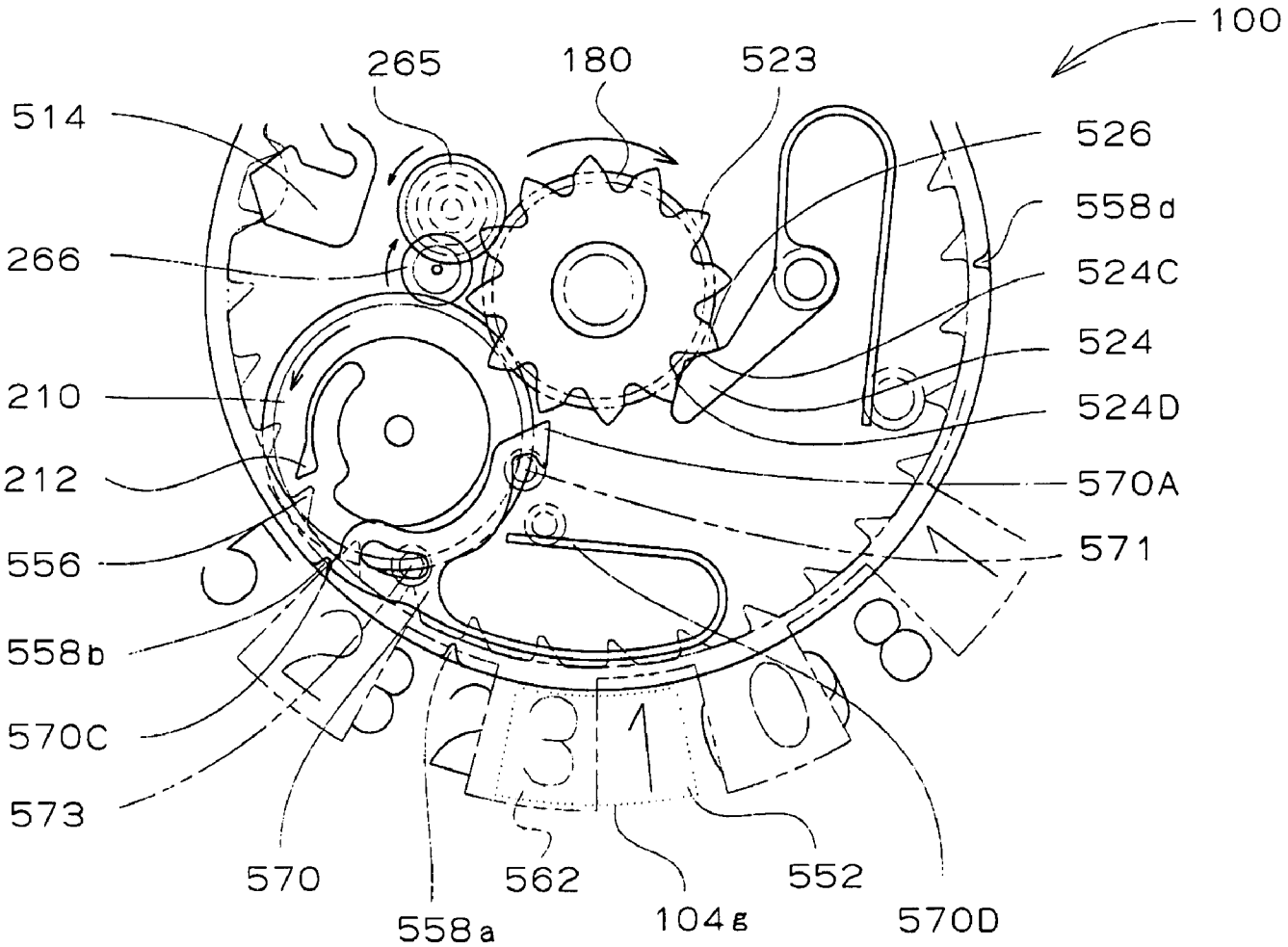
FIG. 14 is a partial plan view of the back side structure of the movement as seen from the dial side prior to the rotation of the first date indicator in the watch with a calendar mechanism of the first embodiment of the present invention.

(1.6.4) State before Rotation of the First Date Indicator:

FIG. 14 is a partial plan view of the back side structure of the movement 100 as seen from the dial side in the state prior to rotation of the first date indicator. Referring to FIG. 14, the date letter displayed through the date window 104*g* by the first date indicator 552 is "1," and the date letter displayed through the date window 104*g* by the second date indicator 562 is "3." Through rotation of the date indicator driving wheel 210 in the direction indicated by the arrow (i.e., counterclockwise), the date feeding finger 212 also rotates counterclockwise.

Figure 15:
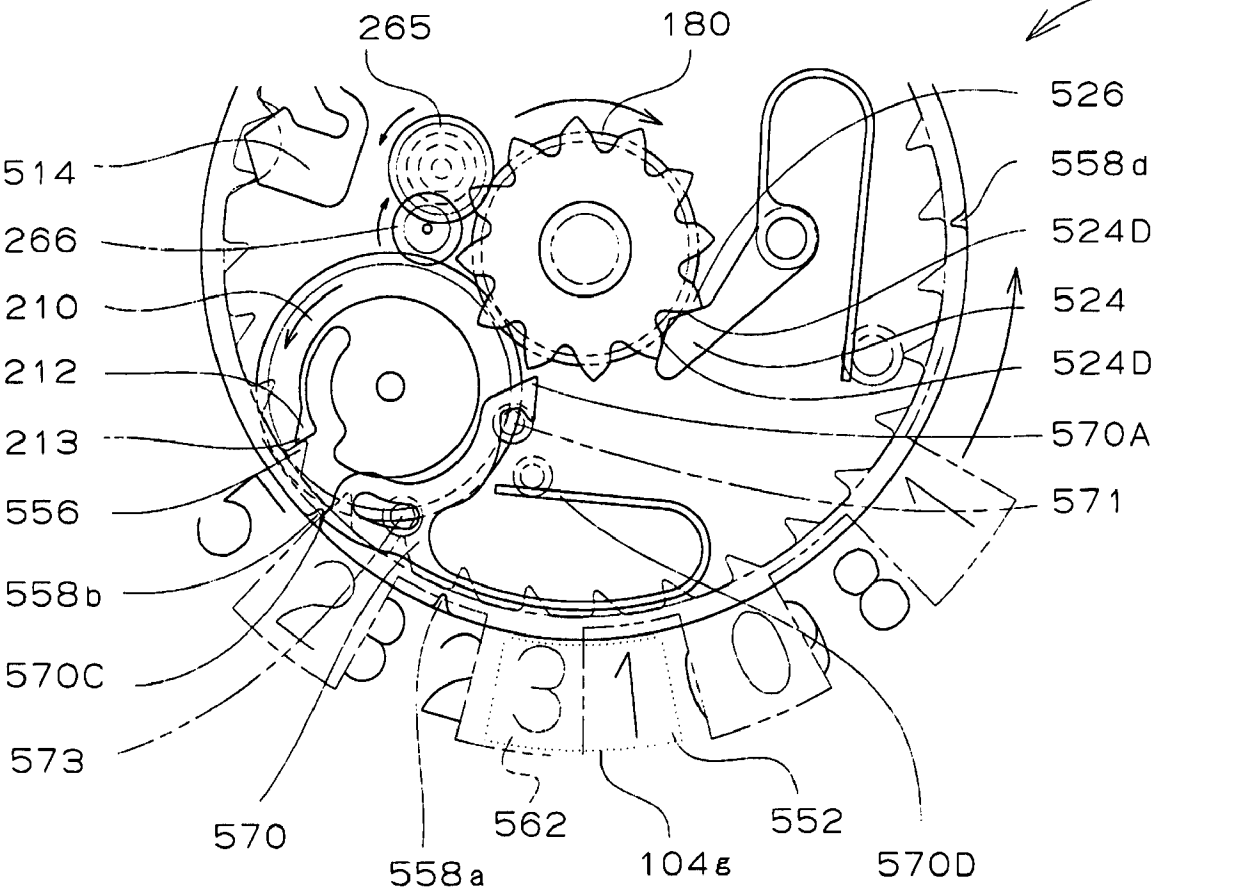
FIG. 15 is a partial plan view of the back side structure of the movement as seen from the dial side, with the first date indicator starting to rotate in the normal direction, in the watch with a calendar mechanism of the first embodiment of the present invention.

(1.6.4) State in which the First Date Indicator is Starting to Rotate in the Normal Direction:

FIG. 15 is a partial plan view of the back side structure of the movement as seen from the dial side in the state in which the first date indicator is starting to rotate in the normal direction. Referring to FIG. 15, through further counterclockwise rotation (in the direction indicated by the arrow in FIG. 15) of the date indicator driving wheel 210, the date feeding finger 212 also further rotates counterclockwise. The date feeding portion 213 of the date feeding finger 212 rotates counterclockwise and comes into contact with the first date indicator tooth portion 556 of the first date indicator 552.

Figure 16:
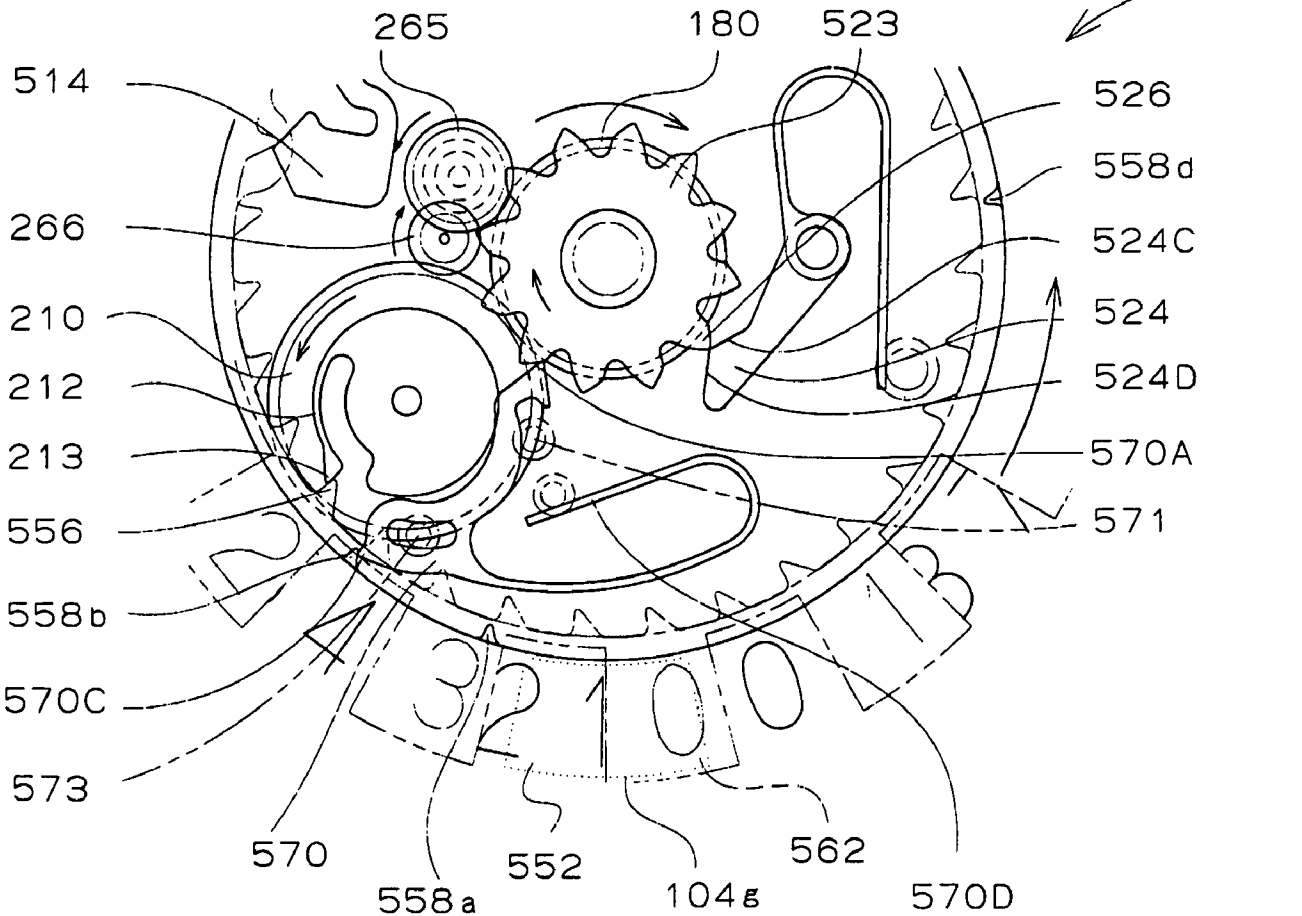
FIG. 16 is a partial plan view of the back side structure of the movement as seen from the dial side, with the first date indicator and the second date indicator starting to rotate in the normal direction and with a tooth end of the second date indicator held in contact with an apex of a second date jumper, in the watch with a calendar mechanism of the first embodiment of the present invention.

(1.6.5) State in which the First Date Indicator and the Second Date Indicator are Starting to Rotate in the Normal Direction:

FIG. 16 is a partial plan view of the structure of the back side of the movement as seen from the dial side in a state in which the first date indicator and the second date indicator are starting to rotate in the normal direction and in which the tooth end of the second date indicator is in contact with the apex of the second date jumper. Referring to FIG. 16, the date feeding portion 213 of the date feeding finger 212 rotates counterclockwise so as to come into contact with the first date indicator tooth portion 556 of the first date indicator 552. When the first date indicator 552 rotates counterclockwise through the rotation of the date feeding finger 212, the second calendar shift tooth 558*b* of the first date indicator 552 comes into contact with the lever feeding operation portion 570C of the second date indicator feeding lever 570. When the second calendar shift tooth 558*b* of the first date indicator 552 is arranged at this position, the second date indicator feeding lever 570 can move toward the positioning tooth portion 526 of the second date star 523. When the second date indicator feeding portion 570A of the second date indicator feeding lever 570 comes into contact with the positioning tooth portion 526 of the second date star 523, the second date indicator 562 rotates clockwise (in the direction indicated by the arrow in FIG. 16). And, the tooth end of the positioning tooth portion 526 of the second date star 523 comes into contact with the apex of a regulating portion of the second date jumper 524. Further, the tooth end of the first date indicator tooth portion 556 of the first date indicator 552 approaches the apex of a regulating portion of the first date jumper 514.

Figure 17:
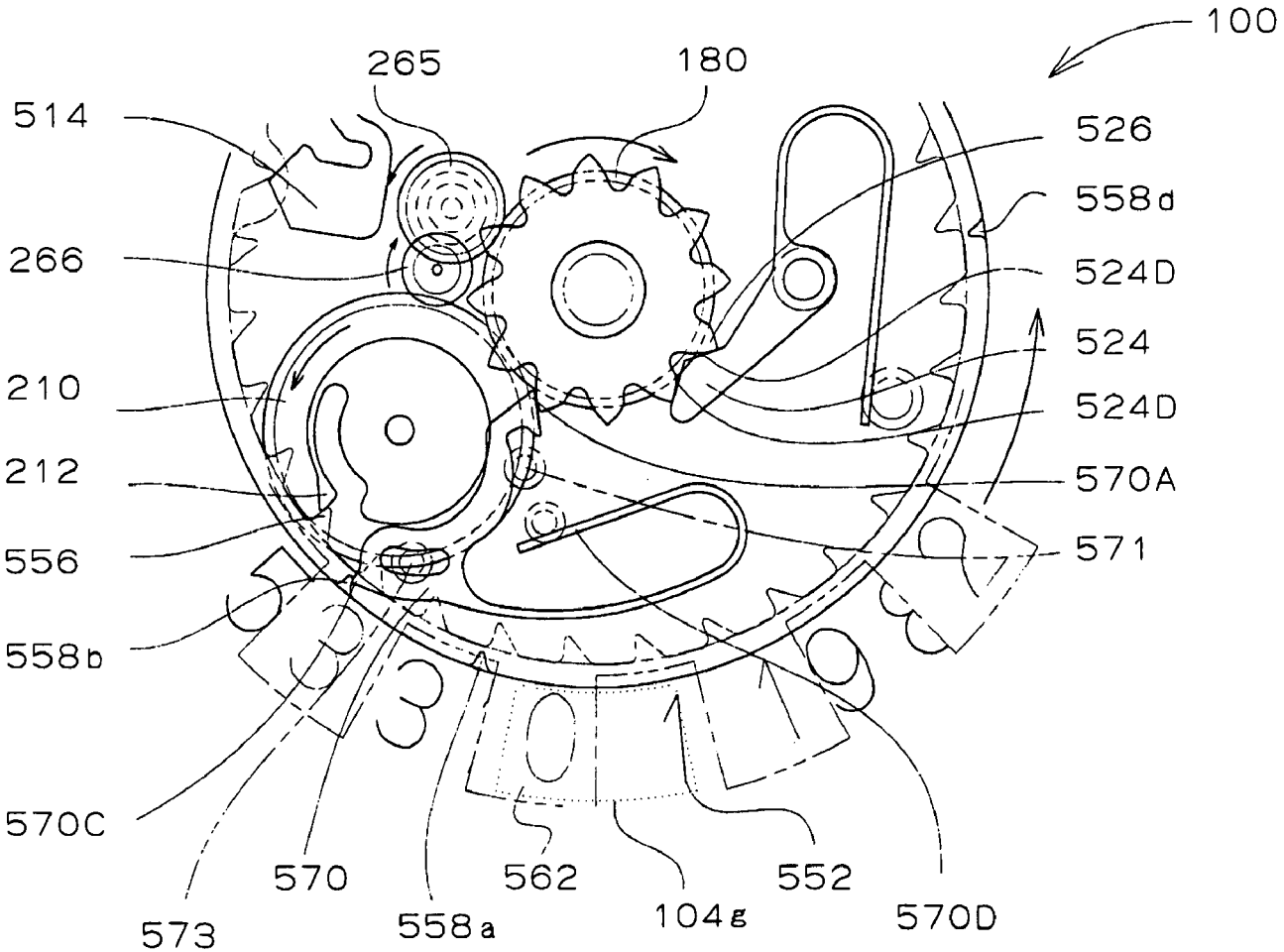
FIG. 17 is a partial plan view of the back side structure of the movement as seen from the dial side, with the first date indicator starting to rotate in the normal direction and with the second date indicator having rotated by one pitch in the normal direction, in the watch with a calendar mechanism of the first embodiment of the present invention.

(1.6.6) State in which the Second Date Indicator has Rotated by One Pitch in the Normal Direction:

FIG. 17 is a partial plan view of the structure of the back side of the movement as seen from the dial side in a state in which the first date indicator is rotating in the normal direction and in which the second date indicator has rotated by one pitch in the normal direction. Referring to FIG. 17, through further rotation of the date feeding finger 212, the second date indicator feeding lever 570 rotates the positioning tooth portion 526 of the second date star 523, and the second date indicator 562 is rotated by one pitch in the normal direction (clockwise) by the force of the second date jumper 524. Thus, in the state shown in FIG. 17, "0" of the second date letters 562*h* is arranged in the left-hand side portion of the date window 104*h* provided in the dial 104.

Figure 18:
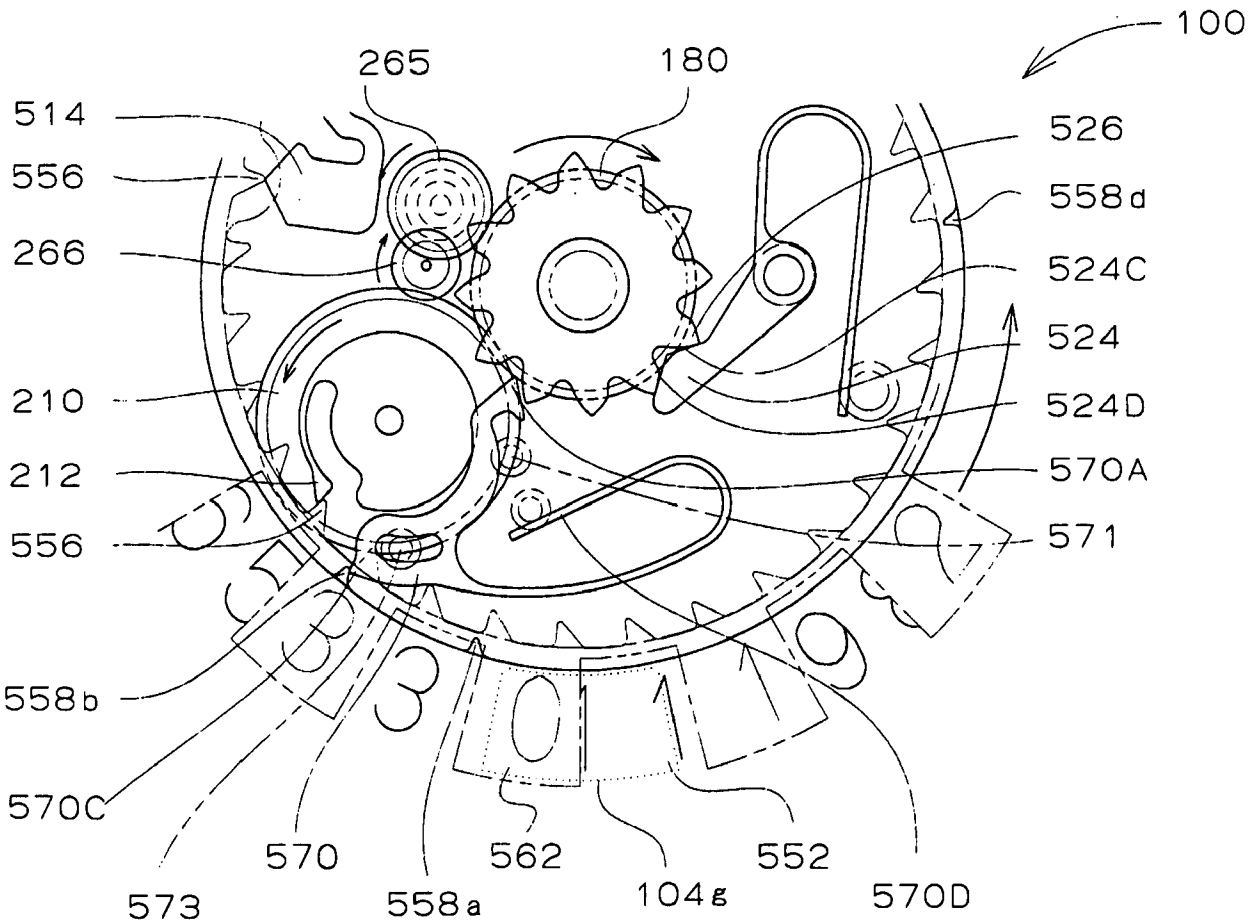
FIG. 18 is a partial plan view of the back side structure of the movement as seen from the dial side, with a tooth portion forward end of the first date indicator held in contact with an apex of a first date jumper, in the watch with a calendar mechanism of the first embodiment of the present invention.

(1.6.7) State in which the Forward End of the Tooth Portion of the First Date Indicator is in Contact with the Apex of the First Date Jumper:

FIG. 18 is a partial plan view of the structure of the back side of the movement as seen from the dial side in a state in which the forward end of the tooth portion of the first date indicator is in contact with the apex of the first date jumper. Referring to FIG. 18, through further rotation of the date feeding finger 212, the tooth end of the first date indicator tooth portion 556 of the first date indicator 552 comes into contact with the apex of the regulating portion of the first date jumper 514.

Figure 19:
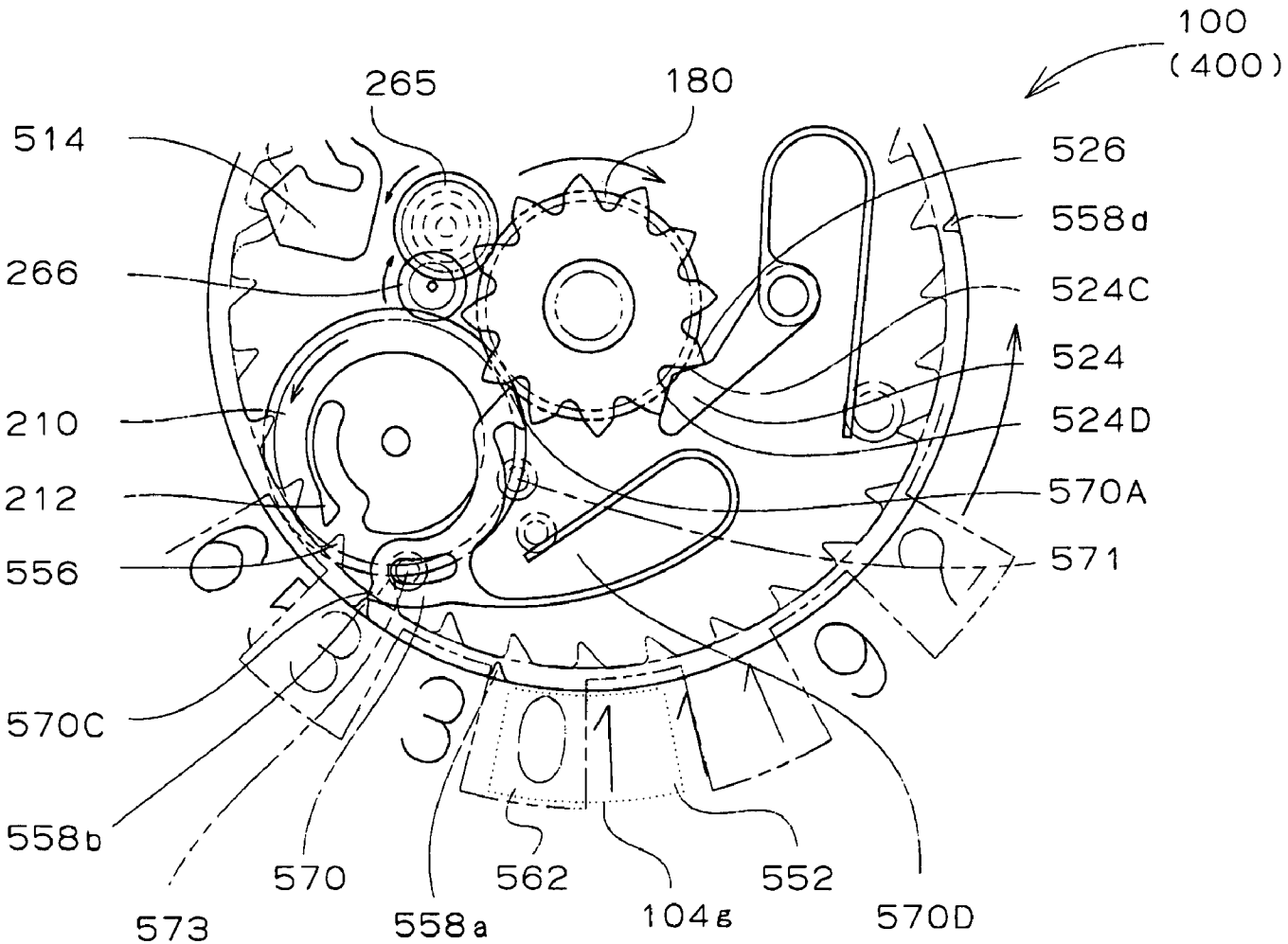
FIG. 19 is a partial plan view of the back side structure of the movement as seen from the dial side, with the first date indicator starting to rotate in the normal direction and with a second date indicator feeding lever having moved to a maximum degree, in the watch with a calendar mechanism of the first embodiment of the present invention.

(1.6.8) State in which the Second Date Indicator Feeding Lever has Moved to a Maximum Degree:

FIG. 19 is a partial plan view of the structure of the back side of the movement as seen from the dial side in a state in which the first date indicator is rotating in the normal direction and in which the second date indicator feeding lever has moved to a maximum degree. Referring to FIG. 19, the second date indicator feeding lever 570 has moved to a maximum degree toward the positioning tooth portion 526 of the second date star 523.

Figure 20:
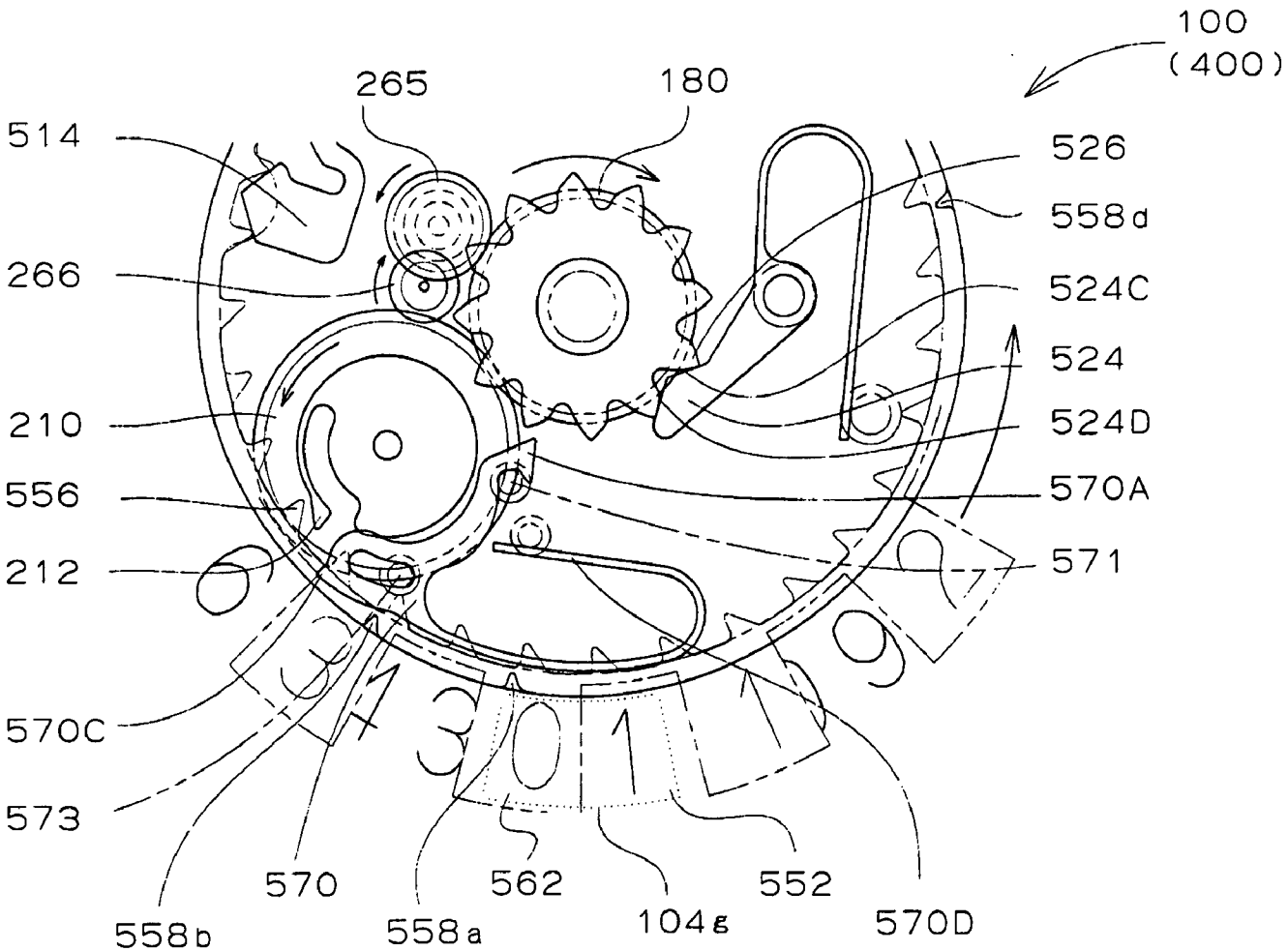
FIG. 20 is a partial plan view of the back side structure of the movement as seen from the dial side, with the first date indicator having rotated by one pitch in the normal direction and with the second date indicator having rotated by one pitch in the normal direction, in the watch with a calendar mechanism of the first embodiment of the present invention.

(1.6.9) State in which the First Date Indicator and the Second Date Indicator have Rotated by One Pitch in the Normal Direction:

FIG. 20 is a partial plan view of the structure of the back side of the movement as seen from the dial side in a state in which the first date indicator has rotated by one pitch in the normal direction and in which the second date indicator has rotated by one pitch in the normal direction. Referring to FIG. 20, through further rotation of the date feeding finger 212, the first date indicator 552 is rotated counterclockwise by one pitch by the force of the first date jumper 514. Thus, in the state shown in FIG. 20, "0" of the second date letters 562*h* is arranged in the left-hand side portion of the date window

104*h* provided in the dial 104, and "1" of the first date letters 552*h* is arranged. Thus, the complete displays the current date of the "01st" day.

(7) Operation of the Watch with a Calendar Mechanism:

(7.1) Display of Time Information:

Referring to FIGS. 1 through 3, 21, and 22, the mainspring (not shown) incorporated into the movement barrel 320 constitutes the power source of the watch. Through winding back (releasing) of the mainspring, the barrel wheel of the movement barrel 320 rotates in one direction, and time information is displayed by the indicator hands (the hour hand, the minute hand, the second hand, etc.) through rotation of the front train wheel and the back train wheel. The rotation of the barrel wheel, which is rotated by the power of the mainspring, is controlled by the governing device and the escapement device. The governing device includes the balance with hairspring 340. The escapement device includes the pallet fork 342 and the escape wheel & pinion 330. Through the rotation of the barrel wheel, the center wheel & pinion 325 rotates. Through the rotation of the center wheel & pinion 325, the third wheel & pinion 326 rotates. Through the rotation of the third wheel & pinion 326, the second wheel & pinion 327 makes one rotation per minute.

The rotating speed of the second wheel & pinion 327 is controlled by the escape wheel & pinion 330. The rotating speed of the escape wheel & pinion 330 is controlled by the pallet fork 342. The rocking movement of the pallet fork 342 is controlled by the balance with hairspring 340. Through the rotation of the movement barrel 320, the minute indicator 329 makes one rotation per hour. A minute hand 462 mounted to the minute indicator 329 indicates the "minute" of the time information. A second hand 460 mounted to the second wheel & pinion 327 indicates the "second" of the time information. The rotation center of the second wheel & pinion 327 and the rotation center of the minute indicator 329 are at the same position. Through the rotation of the minute indicator 329, the minute wheel 166 rotates. Through the rotation of the minute wheel 166, the hour wheel 180 makes one rotation every 12 hours. An hour hand 464 mounted to the hour wheel 180 indicates the "hour" of the time information.

(7.2) Calendar Feeding Operation:

Referring to FIGS. 14 through 20, the operation of changing the date display from "31" to "01" will be described. Referring to FIG. 14, through rotation of the date indicator driving wheel 210 in the direction indicated by the arrow (counterclockwise), the date feeding finger 212 also rotates counterclockwise. Referring to FIG. 15, the date feeding finger 212 also further rotates counterclockwise. The date feeding portion 213 of the date feeding finger 212 rotates counterclockwise to come into contact with the first date indicator tooth portion 556 of the first date indicator 552.

Referring to FIG. 16, when the first date indicator 552 rotates counterclockwise through the rotation of the date feeding finger 212, the second calendar feeding tooth 558*b* of the first date indicator 552 comes into contact with the lever feeding operation portion 570C of the second date indicator feeding lever 570. When the second date indicator feeding portion 570A of the second date indicator feeding lever 570 comes into contact with the positioning tooth portion 526 of the second date star 523, the second date indicator 562 rotates clockwise (in the direction indicated by the arrow in FIG. 16). The tooth end of the positioning tooth portion 526 of the second date star 523 comes into contact with the apex of the regulating portion of the second date jumper 524.

Referring to FIG. 17, the second date indicator feeding lever 570 rotates the positioning tooth portion 526 of the second date star 523, and the second date indicator 562 is rotated one pitch in the normal direction (clockwise) by the force of the second date jumper 524, with "0" of the second date letters 562*h* being arranged in the left-hand side portion of the date window 104*h* provided in the dial 104. Referring to FIG. 18, through further rotation of the date feeding finger 212, the tooth end of the first date indicator tooth portion 556 of the first date indicator 552 comes into contact with the apex of the regulating portion of the first date jumper 514.

Referring to FIG. 19, the second date indicator feeding lever 570 moves to a maximum degree toward the positioning tooth portion 526 of the second date star 523. Referring to FIG. 20, the first date indicator 552 is rotated one pitch counterclockwise by the force of the first date jumper 514, and "1" of the first date letters 552*h* is arranged in the right-hand side portion of the date window 104*h* provided in the dial 104.

Next, the operation of changing the date display from "01" to "02" will be described. Referring to FIG. 20, through rotation of the date indicator driving wheel 210 in the direction indicated by the arrow (counterclockwise), the date feeding finger 212 also rotates counterclockwise. The date feeding portion 213 of the date feeding finger 212 rotates clockwise, and comes into contact with the first date indicator tooth portion 556 of the first date indicator 552. Through further rotation of the date feeding finger 212, the tooth end of the first date indicator tooth portion 556 of the first date indicator 552 comes into contact with the apex of the regulating portion of the first date jumper 514. The first date indicator 552 is rotated one pitch counterclockwise by the force of the first date jumper 514, and "2," which is adjacent to "1" of the first date letters 552*h*, is arranged in the right-hand side portion of the date window 104*h* provided in the dial 104. At the time of this operation, the second date indicator 562 does not rotate. That is, "0" of the second date letters 562*h* remains arranged in the left-hand side portion of the date window 104*h* provided in the dial 104.

What has been described above also applies to the operation of changing the date display from "02" to "03," the operation of changing it from "03" to "04," the operation of changing it from "08" to "09," the operation of changing it from "12" to "13," the operation of changing it from "13" to "14," the operation of changing it from "18" to "19," the operation of changing it from "22" to "23," the operation of changing it from "23" to "24," the operation of changing it from "28" to "29," etc.

Next, the operation of changing the date display from "09" to "10" will be described. Referring to FIG. 1, through rotation of the date indicator driving wheel 210 counterclockwise, the date feeding finger 212 also rotates counterclockwise. The date feeding finger 212 also further rotates counterclockwise. The date feeding portion 213 of the date feeding finger 212 rotates counterclockwise, and comes into contact with the first date indicator tooth portion 556 of the first date indicator 552. When the first date indicator 552 rotates counterclockwise through rotation of the date feeding finger 212, the second calendar shift tooth 558*c* of the first date indicator 552 comes into contact with the lever feeding operation portion 270C of the second date indicator feeding lever 570. When the second date indicator feeding portion 570A of the second date indicator feeding lever 570 comes into contact with the positioning tooth portion 526 of the second date star 523, the second date indicator 562 rotates clockwise. The tooth end of the positioning tooth portion 526 of the second date star 523 comes into contact with the apex of the regulating portion of the second date jumper 524. The second date indicator feeding lever 570 rotates the positioning tooth portion 526 of the second date star 523, and the second date indicator 562 is rotated one pitch clockwise by the force of the second date jumper 524, with "1" of the second date letters 562*h* being arranged in the left-hand side portion of the date window 104*h* provided in the dial 104. Through further rotation of the date feeding finger 212, the tooth end of the first date indicator tooth portion 556 of the first date indicator 552 comes into contact with the apex of the regulating portion of the first date jumper 514. The second date indicator feeding lever 570 moves to a maximum degree toward the positioning tooth portion 526 of the second date star 523. The first date indicator 552 is rotated one pitch counterclockwise by the force of the first date jumper 514, and "0" of the first date letters 552*h* is arranged in the right-hand side portion of the date window 104*h* provided in the dial 104. This also applies to the operation of changing the date display from "19" to "20," and to the operation of changing the date display from "29" to "30."

(8) Operation of the Watch when the Winding Stem is at the 0th Step

Referring to FIGS. 2, 3, and 22, in the state in which the winding stem 110 is at the 0th step, a tooth B 114B of the clutch wheel 114 is in mesh with inner teeth 116A of the winding pinion 116. Thus, when the winding stem 110 is rotated to the right (i.e., when the winding stem 110 is rotated clockwise as seen from the outer side of the watch), the winding pinion 116 rotates based on the rotation of the clutch wheel 114, and the crown wheel rotates. Based on the rotation of the crown wheel, the crown transmission wheel rotates. Through the rotation of the crown transmission wheel, the ratchet sliding wheel rocks as it rotates, and comes into mesh with the ratchet wheel, rotating the ratchet wheel in a fixed direction. A click (not shown) is provided so as to prevent reverse rotation of the ratchet wheel.

Based on the rotation of the ratchet wheel, the barrel arbor rotates, winding up the mainspring. Due to the power of the mainspring, the barrel wheel rotates in a fixed direction. Based on the rotation of the barrel wheel, the front train wheel rotates, rotating the second hand and the minute hand constituting the time display members. The rotating speed of the front train wheel is adjusted by the governing device including the balance with hairspring, and the escapement device. Based on the rotation of the front train wheel, the back train wheel including the minute wheel and the hour wheel rotates, thereby rotating the hour hand. Further, based on the rotation of the hour wheel, the date feeding mechanism including the first intermediate date feeding wheel, the second intermediate date feeding wheel, the date feeding wheel, etc. operates to rotate the first date indicator and the second date indicator.

(9) Operation of the Watch when the Winding Stem is at the 1st Step: Operation of Date Correction for the 1 Place of a Date:

Referring to FIGS. 1 through 3 and 22, the winding stem 110 is drawn out by one step from the state in which it is at the 0th step to attain a state in which the winding stem 110 is at the 1st step. When the winding stem 110 is drawn out by one step, the setting lever 120 rotates counterclockwise, causing the yoke 122 to rotate clockwise. In this state, the teeth A 114A of the clutch wheel 114 are in mesh with the setting wheel 128, and the teeth B 114B of the clutch wheel 114 are out of mesh with the inner side teeth 116A of the winding pinion 116.

As described above, when the winding stem 110 is at the 1st step, the balance setting lever 170 is rotated clockwise by the setting lever 120, and the rocking bar abutment portion of the balance setting lever 170 abuts the first correction transmission wheel shaft portion to effect positioning. Due to the action of the balance setting lever 170, the rocking bar 130 rotates counterclockwise, and the second correction transmission wheel shaft portion abuts the cylindrical wall surface of the rocking bar positioning hole. In this state, the balance setting lever 170 does not come into contact with the balance with hairspring 210.

When the winding stem 110 is rotated to the right (i.e., when the winding stem 110 is rotated clockwise as seen from the outside of the watch), the setting wheel 128 rotates counterclockwise based on the rotation of the clutch wheel 114. Based on the rotation of the setting wheel 128, the first correction transmission wheel 132 rotates clockwise. Based on the rotation of the first correction transmission wheel 132, the second correction transmission wheel 134 rotates counterclockwise. Based on the rotation of the second correction transmission wheel 134, the third correction transmission wheel 140 rotates clockwise. Then, the locking lever 142 rotates clockwise, and the correction wheel shaft portion abuts the cylindrical wall surface of the rocking lever positioning hole to effect positioning. When, in this state, the winding stem 110 is rotated to the right, the third correction transmission wheel 140 can slip with respect to the rocking lever 142.

Based on the rotation of the third correction transmission wheel 140, the correction wheel 144 rotates counterclockwise to the position indicated by the solid line in FIG. 22. Based on this rotation of the correction wheel 144, the first date indicator 512 rotates counterclockwise. The position in the rotating direction of the first date indicator 512 is determined by the first date jumper 514. As described above, in the watch of the present invention, the winding stem 110 is rotated to the right, with the winding stem 110 being at the 1st step, to thereby rotate the first date indicator 512, thereby making it possible to correct the date display of the 1 place of a date.

(10) Operation of the Watch in the State in which the Winding Stem is at the 2nd Step:

Referring to FIGS. 1 through 3 and 22, the winding stem 110 is further drawn out by one step from the 1st step to attain a state in which the winding stem 110 is at the 2nd step. When the winding stem 110 is further drawn out by one step, the setting lever 120 further rotates counterclockwise. In this operation, the yoke 122 does not rotate. Thus, as in the state in the winding stem 110 is at the 1st step, in the state in which it is at the 2nd step, the teeth A 114A of the clutch wheel 114 remain in mesh with the setting wheel 128, and the teeth B 114B of the clutch wheel 114 are out of mesh with the inner side teeth 116A of the winding pinion 116.

When the winding stem 110 is at the 2nd step, the balance setting lever 170 is rotated counterclockwise through rotation of the setting lever 120, and the balance setting pin 170A of the balance setting lever 170 abuts the outer periphery of the balance wheel portion of the balance with hairspring 340 to stop the rotation of the balance with hairspring 340. As a result, the pallet fork 342 and the escape wheel & pinion 330 do not operate, and the rotation of the second wheel & pinion 327 is set, with the rotation of the second hand 460 being stopped.

The balance setting pin 170A of the balance setting lever 170 may be formed by the end surface of the balance setting lever 170 or may be formed by bending the end surface of the balance setting lever 170 at right angles. Through rotation of the setting lever 120, the pin provided at the forward end portion of the setting lever 120 pushes the setting lever engagement portion 130E of the rocking bar 130. Then, the rocking bar 130 rotates clockwise, and the second correction transmission wheel shaft portion abuts the cylindrical wall surface of the rocking bar positioning hole. Then, the second intermediate minute wheel 162 comes into mesh with the minute wheel 166.

When the winding stem 110 is rotated to the right (i.e., when the winding stem 110 is rotated clockwise as seen from the outside of the watch), the setting wheel 128 rotates counterclockwise based on the rotation of the clutch wheel 114. Based on the rotation of the setting wheel 128, the first intermediate minute wheel 160 rotates clockwise. Based on the rotation of the first intermediate minute wheel 160, the second intermediate minute wheel 162 rotates counterclockwise. Based on the rotation of the second intermediate minute wheel 162, the minute wheel 166 rotates clockwise. Based on the rotation of the minute wheel 166, the hour wheel 180 and the minute indicator 329 rotate counterclockwise. Thus, when the winding stem 110 is at the 2nd step, it is possible to effect so-called "reverse hand matching" through rotation of the winding stem 110 to the right.

When the winding stem 110 is rotated to the left (i.e., when the winding stem 110 is rotated counterclockwise as seen from the outside of the watch), the setting wheel 128 rotates clockwise based on the rotation of the clutch wheel 114. Based on the rotation of the setting wheel 128, the first intermediate minute wheel 160 rotates counterclockwise. Based on the rotation of the first intermediate minute wheel 160, the second intermediate minute wheel 162 rotates clockwise. Based on the rotation of the second intermediate minute wheel 162, the minute wheel 166 rotates counterclockwise. Based on the rotation of the minute wheel 166, the hour wheel 180 and the minute indicator 329 rotate clockwise. Thus, when the winding stem 110 is at the 2nd step, it is possible to effect so-called "normal hand matching" through rotation of the winding stem 110 to the left.

Through rotation of the hour wheel 180, it is possible to correct the "hour" display of the hour hand 464 mounted to the hour wheel 180. Through rotation of a cannon pinion of the minute indicator 329, it is possible to correct the "minute" display of the minute hand 462 mounted to the minute indicator 329. And, due to the action of the balance setting lever 170, the "second" display undergoes no change during the correction of the "hour" and "minute" display.

(2) Second Embodiment:

Next, a watch with a calendar mechanism according to a second embodiment of the present invention will be described. In the following description, the differences between the watch with a calendar mechanism of the second embodiment of the present invention and the watch with a calendar mechanism of the first embodiment of the present invention will be mainly described. Thus, where there is no corresponding description, the above description of the watch with a calendar mechanism of the first embodiment of the present invention is applicable.

Figure 23:
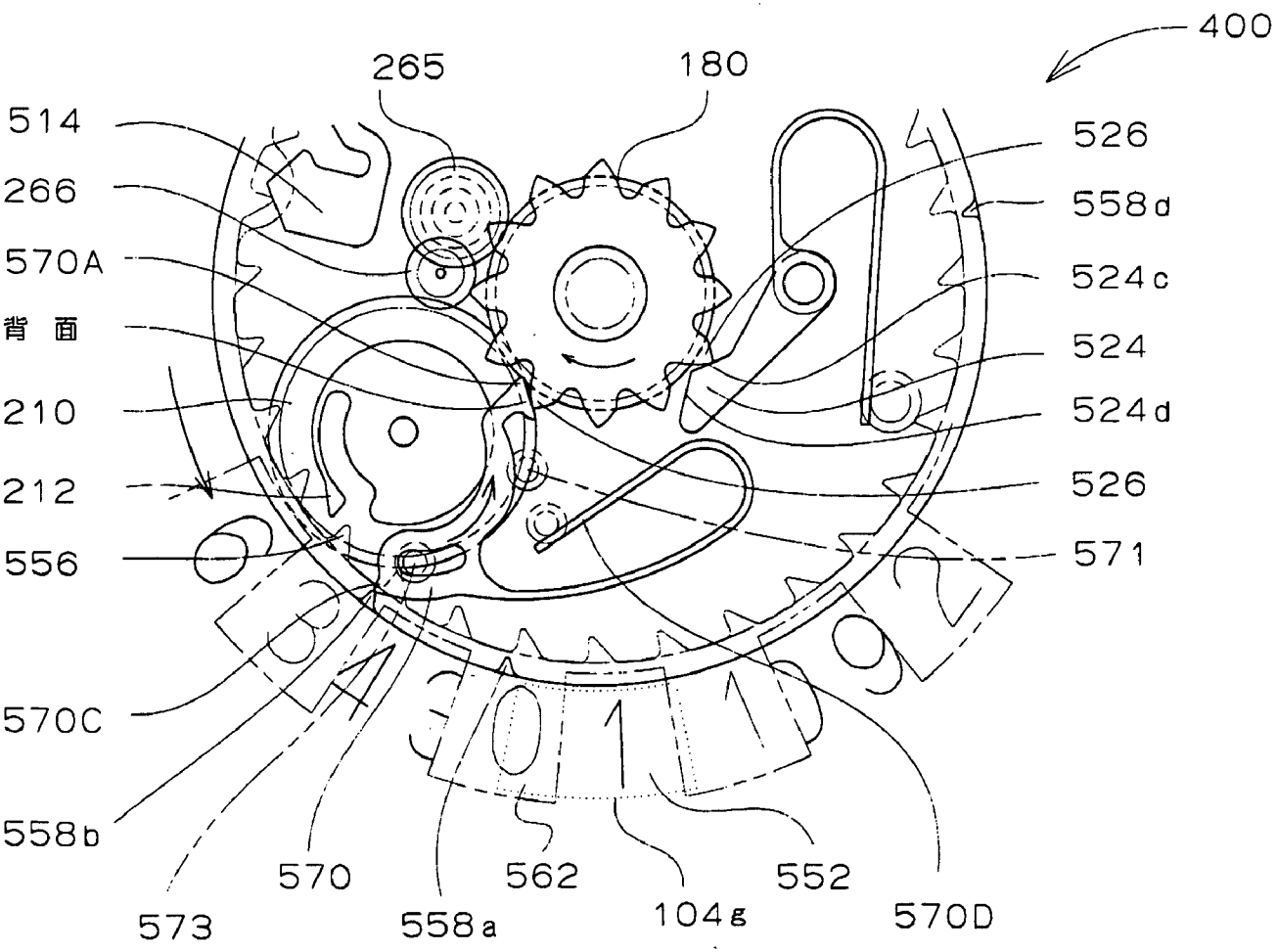
FIG. 23 is a partial plan view showing how the second date indicator makes an excessive rotation to cause a tooth portion of the second date indicator to come into contact with the back surface of the second date indicator feeding lever in the watch with a calendar mechanism of the first embodiment of the present invention.

Referring to FIG. 19, the second date indicator feeding lever 570 has moved to a maximum degree toward a tooth portion 566 of the second date star 523 of the second date indicator 562. Referring to FIG. 20, through further rotation of the date feeding finger 212, the first date indicator 552 has been rotated one pitch counterclockwise by the force of the first date jumper 514. Referring to FIG. 23, in a movement 400, through further rotation of the date feeding finger 212, the first date indicator 552 has been rotated one pitch counterclockwise by the force of the first date jumper 514.

Figure 24:
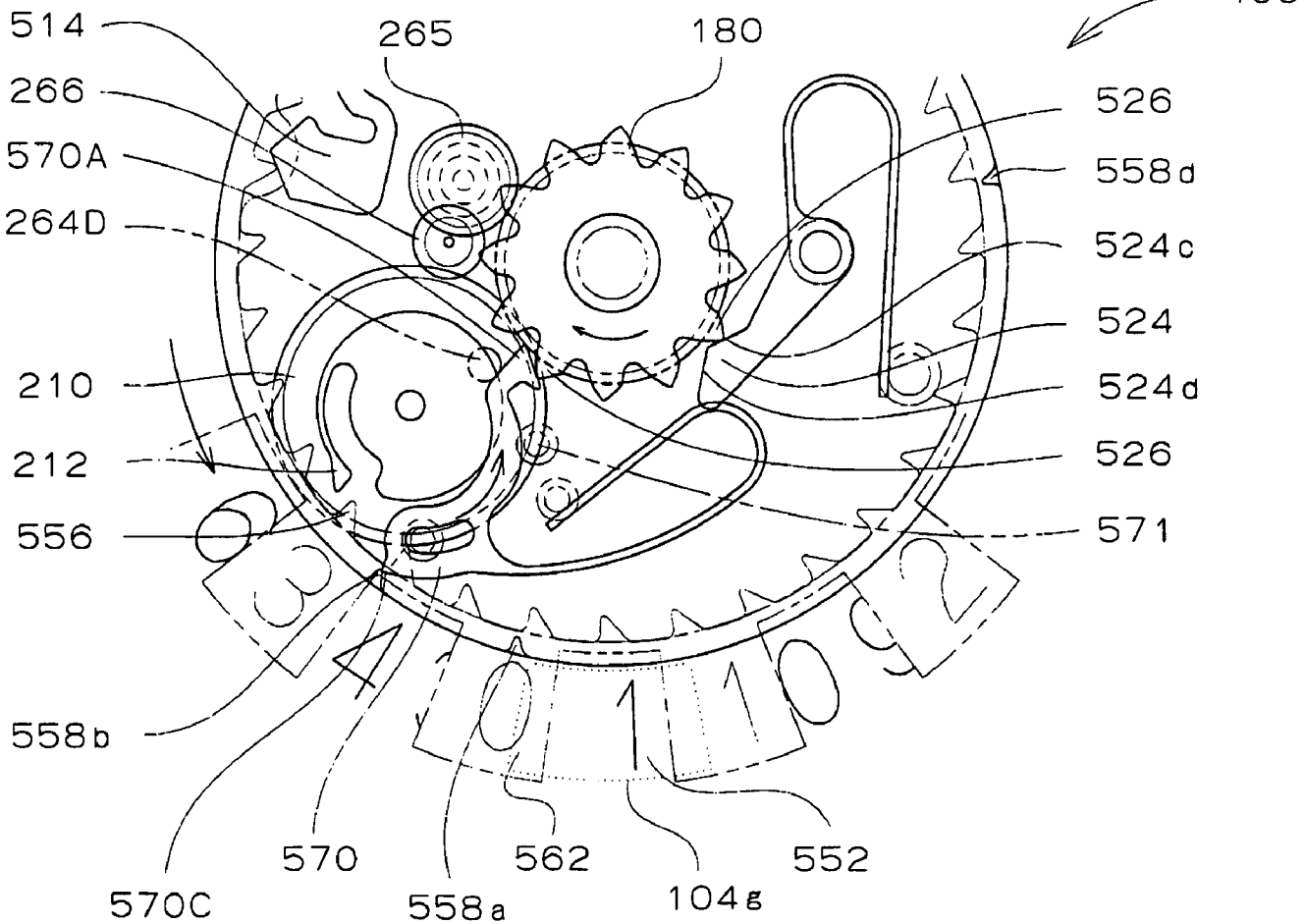
FIG. 24 is a partial plan view showing how the second date indicator makes an excessive rotation to cause a positioning tooth portion of the second date indicator to come into contact with the back surface of the second date indicator feeding lever and how the second date feeding lever comes into contact with a baffle pin provided on a date indicator maintaining plate in a watch with a calendar mechanism according to a second embodiment of the present invention.

Referring to FIG. 23, there is shown a state in which the second date indicator 562 has made an excessive rotation, bringing the positioning tooth portion 526 of the second date star 523 of the second date indicator 562 into contact with the back surface of the second date indicator feeding lever 570. FIG. 24 is a partial plan view showing a state in which the second date indicator 562 has made an excessive rotation, bringing the positioning tooth portion 526 of the second date indicator 562 into contact with the back surface of the second date indicator feeding lever 570, and in which the second date indicator feeding lever 570 has come into contact with the baffle pin 264D provided on the date indicator maintaining plate 264. That is, in the watch with a calendar mechanism of the second embodiment of the present invention, the date indicator maintaining plate 264 is provided with the baffle pin 264D in order to prevent excessive rotation of the second date indicator 562.

In a state in which the lever feeding operation portion 570C of the second date indicator feeding lever 570 is off the rotation path of the first date indicator tooth portion 556 of the first date indicator 512 and in which the second date indicator feeding portion 570A of the second date indicator feeding lever 570 is between the baffle pin 264D and the positioning tooth portion 526 of the second date star 523, the baffle pin 264D is preferably arranged at a position where the positioning tooth portion 526 of the second date star 523 having made an excessive rotation does not go beyond the apex of the regulating portion of the second date jumper. The baffle pin 264D is arranged so as not to enter the rotation path of the positioning tooth portion 526 of the second date star 523.

In this construction, the second date indicator feeding lever 570 rotates to come into contact with the baffle pin 264D, so that the movement range of the second date indicator feeding lever 570 is restricted. Thus, in the state in which the second date indicator feeding lever 570 is held in contact with the baffle pin 264D, the positioning tooth portion 526 of the second date star 523 comes into contact with the second date feeding lever 570, so that it is possible to effectively prevent excessive rotation of the second date indicator 562. That is, due to this construction, when the user rotates the crown to correct the date display, it is possible to prevent occurrence of excessive rotation of the second date indicator 562, and there is no fear of the first date indicator 552 and the second date indicator 562 being out of phase with each other.

(3) Third Embodiment:

Next, a watch with a calendar mechanism according to a third embodiment of the present invention will be described. In the following, the differences between the watch with a calendar mechanism of the third embodiment of the present invention and the watch with a calendar mechanism of the first embodiment of the present invention will be mainly described. Thus, in the following, where there is no corresponding description, the above description of the watch with a calendar mechanism of the first embodiment of the present invention is applicable. The watch with a calendar mechanism of the third embodiment of the present invention consists of an analog electronic watch. In applying the present invention to an analog electronic watch, the construction and operation of the switching mechanism, the calendar feeding mechanism, and the calendar correction mechanism are the same as those of the first embodiment described above.

Figure 25:
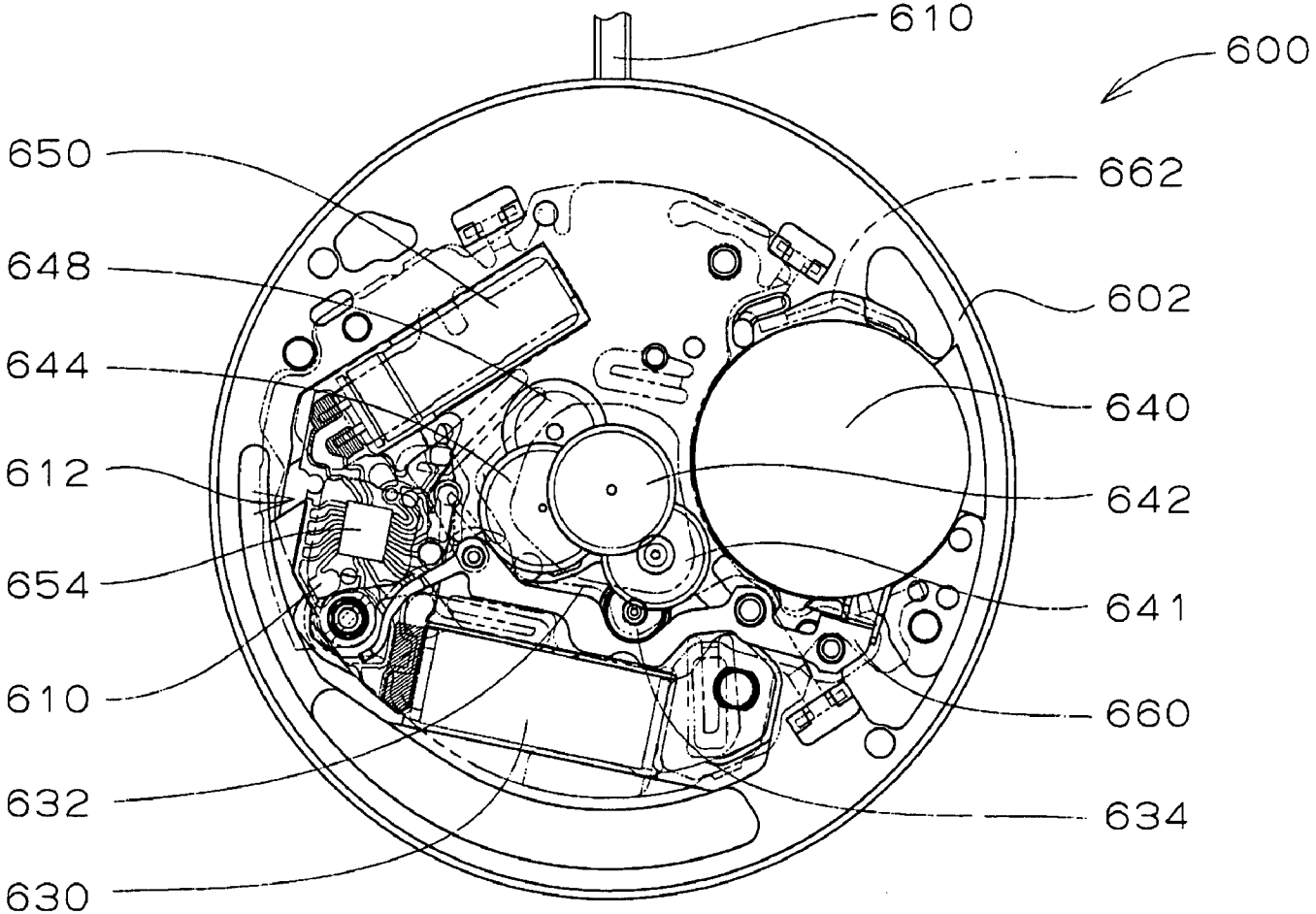
FIG. 25 is a schematic plan view of the structure of a movement formed by an electronic watch as seen from the case back side in a watch with a calendar mechanism according to a third embodiment of the present invention.

Referring to FIG. 25, a movement 600 is formed by an analog electronic watch. The movement 600 includes a main plate 602 constituting the base plate of the movement. A dial (not shown) is mounted to the glass side of the movement 600. A winding stem 610 is rotatably incorporated into the main plate 602. A switching device includes the winding stem 610, a setting lever (not shown), a yoke (not shown), and a yoke holder (not shown). A setting device includes a train wheel setting lever (not shown). In the movement 600, a battery 640 constituting the power source of the watch is arranged on the case back side (front side) of the main plate 602. In the movement 600, it is desirable for the center of the battery 640 to be arranged between the "10 o'clock direction" and the "2 o'clock direction." In the movement 600, it is more desirable for the center of the battery 640 to be arranged between the "11 o'clock direction" and the "1 o'clock direction." A crystal oscillator unit 650 constituting the oscillation source of the watch is arranged on the case back side of the main plate 602. A crystal oscillator is accommodated in the crystal oscillator unit 650. An integrated circuit (IC) 654 contains a motor drive portion (driver) which outputs a motor drive signal to a step motor based on the oscillation of the crystal oscillator.

The crystal oscillator unit 650 and the integrated circuit 654 are fixed to a circuit board 610. In the circuit board 610, the crystal oscillator unit 650 and the integrated circuit 654 constitute a circuit block 612. The circuit block 612 is arranged on the case back side of the main plate 602. A battery negative terminal 660 is provided for conduction between the cathode of the battery 640 and the negative pattern of the circuit board 610. A battery positive terminal 662 is provided for conduction between the anode of the battery 640 and the positive pattern of the circuit board 610. A coil block 630, a stator 632, and a rotor 634 constituting a step motor are arranged on the case back side of the main plate 602.

Through rotation of the rotor 634, a fifth wheel & pinion 641 is rotated. Through the rotation of the fifth wheel & pinion 641, a second wheel & pinion 642 is rotated. Through the rotation of the second wheel & pinion 642, a third wheel & pinion 644 is rotated. Through the rotation of the third wheel & pinion 644, a center wheel & pinion (not shown) is rotated. Through the rotation of the center wheel & pinion, a minute wheel 648 is rotated. Through the rotation of the minute wheel 648, an hour wheel (not shown) is rotated. An hour hand (not shown) is mounted to the hour wheel. The hour wheel makes one rotation every 12 hours. When the winding stem 610 is at the 0th step, and when the winding stem 610 is at the 1st step, a train wheel setting lever does not set the wheel portion of the second wheel & pinion 642 or the fifth wheel & pinion 641.

The second wheel & pinion 642 makes one rotation per minute. The center wheel & pinion makes one rotation per hour. A slip mechanism is provided on the center wheel & pinion. When the winding stem 610 is drawn out to the 2nd step for hand matching, the train wheel setting lever (not shown) sets the wheel portion of the second wheel & pinion 642 or the fifth wheel & pinion 641 to stop the rotation of the second hand. A central pipe (not shown) is fixed to the main plate 602. The central pipe extends from the case back side of the main plate 602 to the dial side of the main plate 602. A train wheel bridge (not shown) rotatably supporting the front train wheel is arranged on the case back side of the main plate 602.

On the back side of the movement 600, it is possible to operate a date feeding mechanism (not shown) through rotation of two intermediate date wheels through the rotation of the hour wheel. A date indicator driving wheel (not shown) arranged on the back side of the movement 600 is preferably arranged so as not to overlap the battery 640 arranged on the front side of the movement 600 as seen in sectional view. The construction and operation of the date feeding mechanism of the watch with a calendar mechanism of the third embodiment of the present invention are the same as the construction and operation of the date feeding mechanism of the watch with a calendar mechanism of the first embodiment of the present invention.

The watch with a calendar mechanism of the present invention includes a first date indicator displaying the 1 place of a date and a second date indicator displaying the 10 place of a date, and can reliably display dates in large letters; further, it allows for the production of a watch with a calendar mechanism that is small in thickness and little restricted in terms of design. The watch with a calendar mechanism of the present invention does not involve any increase in the number of times that the calendar mechanism has to be corrected at month ends, thus providing a satisfactory operability.

What is claimed is:

1. A watch with a calendar mechanism having two date indicators, comprising:

a first date indicator that displays a ones place of a date;

a first date jumper for setting a position of the first date indicator in a rotating direction of the first date indicator;

a second date indicator that displays a tens place of the date;

a second date jumper for setting a position of the second date indicator in a rotating direction of the second date indicator; and a second date indicator feeding lever for undergoing movement based on rotation of the first date indicator and for rotating the second date indicator, the second date indicator feeding lever undergoing movement from a first position to a second position toward the second date indicator based on rotation of the first date indicator and being restored to the first position by a spring force;

wherein the first date indicator and the second date indicator are arranged so as to have common rotation centers; and wherein the first date indicator comprises 31 first date indicator tooth portions formed at equal angular intervals as inner teeth and four calendar shift teeth formed as inner teeth, the calendar shift teeth comprising a first calendar shift tooth serving as a reference, a second calendar shift tooth formed at an interval of 720/31 degrees in a first direction using the first calendar shift tooth as a reference, a third calendar shift tooth formed at an interval of 3240/31 degrees in the first direction using the second calendar shift tooth as a reference, and a fourth calendar shift tooth formed at an interval of 3600/31 degrees in a second direction opposite to the first direction using the first calendar shift tooth as a reference.

2. A watch with a calendar mechanism according to claim 1; wherein the second date indicator feeding lever undergoes movement under the guidance of a second date indicator feeding lever guide pin.

3. A watch with a calendar mechanism according to claim 1; further comprising a baffle pin for preventing rotation of the second date indicator over a preselected rotation amount; wherein when rotation of the second date indicator exceeds the preselected rotation amount, the second date indicator feeding lever is configured to come into contact with the baffle pin.

4. A watch with a calendar mechanism comprising:

a first date indicator mounted to undergo rotation for displaying a ones place of a date, the first date indicator having a plurality of calendar shift teeth and a plurality of first date indicator tooth portions, the plurality of calendar shift teeth comprising a first calendar shift tooth, a second calendar shift tooth arranged relative to the first calendar shift tooth at a first interval, a third calendar shift tooth arranged relative to the second calendar shift tooth at a second interval greater than the first interval, and a fourth calendar shift tooth arranged relative to the first calendar shift tooth at a third interval greater than each of the first and second intervals;

a second date indicator mounted to undergo rotation for displaying a tens place of the date; and a second date indicator feeding lever for rotating the second date indicator and having a spring portion, the second date indicator feeding lever being mounted to undergo movement from a first position to a second position toward the second date indicator in accordance with rotation of the first date indicator and being restored to the first position by a spring force of the spring portion.

5. A watch with a calendar mechanism according to claim 4; further comprising a first date jumper for setting a position of the first date indicator in a rotating direction of the first date indicator, and a second date jumper for setting a position of the second date indicator in a rotating direction of the second date indicator.

6. A watch with a calendar mechanism according to claim 4; further comprising a guide pin for guiding movement of the second date indicator feeding lever.

7. A watch with a calendar mechanism according to claim 4; further comprising a baffle pin for preventing rotation of the second date indicator over a preselected rotation amount; wherein the second date indicator feeding lever is brought into contact with the baffle pin when rotation of the second date indicator exceeds the preselected rotation amount.

8. A watch with a calendar mechanism according to claim 4; wherein the first interval is 720/31 degrees, the second interval is 3240/31 degrees, and the third interval is 3600/31 degrees.

9. A watch with a calendar mechanism according to claim 4; wherein the first and second date indicators are mounted to undergo rotation about a common rotation center.

10. A watch with a calendar mechanism according to claim 4; wherein the plurality of first date indicator tooth portions are arranged at equal intervals.

* * * * *